US007926236B2

(12) United States Patent
Konstantin

(10) Patent No.: US 7,926,236 B2
(45) **Date of Patent: *Apr. 19, 2011**

(54) LIGHT TRANSMISSION PANELS, RETAINING CLIP AND A COMBINATION THEREOF

(75) Inventor: Moshe Konstantin, Highland Park, IL (US)

(73) Assignee: Konvin Associates Limited Partnership, Lake Forest (IL)

( * ) Notice: Subject to any disclaimer, the term of this patent is extended or adjusted under 35 U.S.C. 154(b) by 84 days.

This patent is subject to a terminal disclaimer.

(21) Appl. No.: 12/259,034

(22) Filed: Oct. 27, 2008

(65) Prior Publication Data

US 2009/0049771 A1 Feb. 26, 2009

Related U.S. Application Data

(63) Continuation-in-part of application No. 10/607,748, filed on Jun. 27, 2003, now Pat. No. 7,441,379.

(51) Int. Cl.
*E04C 3/00* (2006.01)
*E04B 2/14* (2006.01)
*E04D 1/34* (2006.01)

(52) U.S. Cl. ..... 52/466; 52/459; 52/461; 52/460; 52/57; 52/465

(58) Field of Classification Search ..... 52/200, 52/469, 461, 460, 582.1, 459, 463, 471, 584.1, 52/582.2, 464, 57, 465, 470
See application file for complete search history.

(56) References Cited

U.S. PATENT DOCUMENTS

| | | | | |
|---|---|---|---|---|
| 783,807 | A | 2/1905 | Tuteur | |
| 1,220,219 | A | 3/1917 | Goldman | |
| 3,473,276 | A | 10/1969 | Back et al. | |
| 3,483,665 | A | 12/1969 | Miller | |
| 3,975,880 | A | 8/1976 | Fischer, Jr. | |
| 4,075,811 | A | 2/1978 | Keith | |
| 4,117,638 | A | 10/1978 | Kidd et al. | |
| 4,135,342 | A * | 1/1979 | Cotter | 52/461 |
| 4,139,974 | A | 2/1979 | Fox | |
| 4,271,651 | A | 6/1981 | Sorrells, Jr. | |
| 4,389,823 | A | 6/1983 | Player | |

(Continued)

FOREIGN PATENT DOCUMENTS

| | | |
|---|---|---|
| EP | 490633 | 6/1992 |

(Continued)

*Primary Examiner* — Phi Dieu Tran A
(74) *Attorney, Agent, or Firm* — Fitch Even Tabin & Flannery

(57) ABSTRACT

A glazing panel system is provided with improved glazing panels, retention clips and/or U-shaped connectors. The retention clip may engage the glazing panels at locations lower than top ends of the upstanding seam flanges. In one embodiment, an internal U-shaped connector is positioned to engage the seam flanges while an external U-shaped connector covers the internal connector and the seam between adjacent glazing panels. The glazing panels may be formed with pockets adjacent the base of the upstanding seam flanges to receive a portion of the retention clip to apply retention forces at locations below the upper ends of the seam flanges. The retention clips may be formed with an upper transverse portion that is movable relative to the base portion of the clip to accommodate panel expansion and contraction. Also, a thicker plate or portion may be provided at a top flange for the retention clip to provide increased resistance to uplift loads trying to bend the flange.

15 Claims, 15 Drawing Sheets

U.S. PATENT DOCUMENTS

| | | | | |
|---|---|---|---|---|
| 4,402,168 | A | 9/1983 | Maier, Jr. | |
| 4,435,935 | A * | 3/1984 | Larrea | 52/461 |
| 4,435,937 | A | 3/1984 | Stone | |
| 4,573,300 | A | 3/1986 | Bezner | |
| 4,649,684 | A | 3/1987 | Petree et al. | |
| 4,920,725 | A | 5/1990 | Gore | |
| 4,998,395 | A | 3/1991 | Bezner | |
| 5,363,624 | A | 11/1994 | Cotter | |
| 5,584,155 | A | 12/1996 | Watanabe | |
| 6,151,845 | A | 11/2000 | Lancaster | |
| 6,164,024 | A | 12/2000 | Konstantin | |
| 6,202,382 | B1 * | 3/2001 | Conterno | 52/762 |
| 6,272,812 | B1 | 8/2001 | Richardson | |
| 6,487,821 | B1 | 12/2002 | Thomsen et al. | |
| 6,591,557 | B1 | 7/2003 | Thomsen et al. | |
| 6,637,170 | B2 | 10/2003 | Ito | |
| 6,807,779 | B1 | 10/2004 | Hocker et al. | |
| 6,845,592 | B2 | 1/2005 | Voegele | |
| 6,988,344 | B1 | 1/2006 | Krueger | |
| 7,313,893 | B2 | 1/2008 | Voegele, Jr. | |
| 7,441,379 | B2 | 10/2008 | Konstantin | |
| 7,546,708 | B2 | 6/2009 | Konstantin | |
| 7,765,760 | B2 | 8/2010 | Konstantin | |
| 2001/0029708 | A1 | 10/2001 | Richardson | |
| 2010/0242397 | A1 | 9/2010 | Givoni et al. | |

FOREIGN PATENT DOCUMENTS

| | | |
|---|---|---|
| GB | 2204627 | 11/1988 |
| GB | 2214961 | 9/1989 |

* cited by examiner

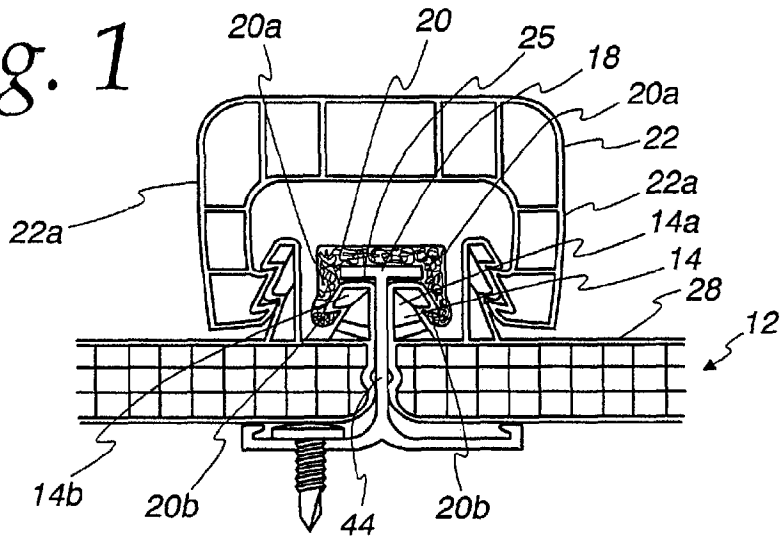
Fig. 1
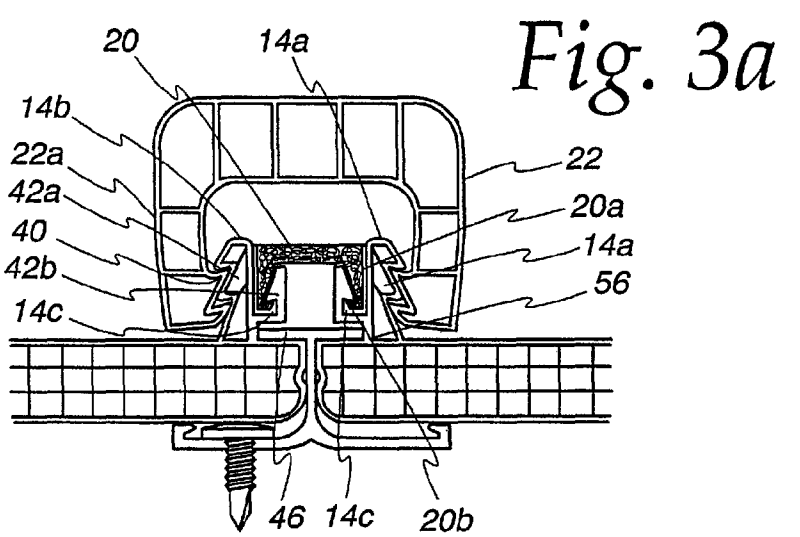
Fig. 3a
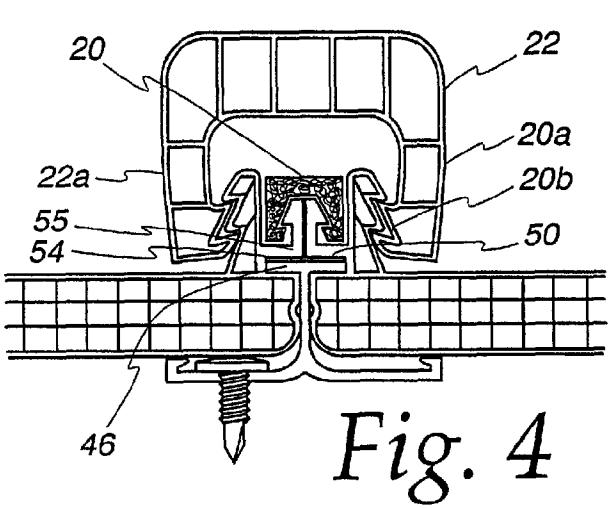
Fig. 2
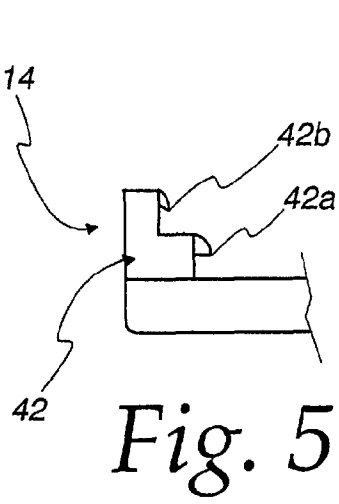
Fig. 4
Fig. 5

LIGHT TRANSMISSION PANELS, RETAINING CLIP AND A COMBINATION THEREOF

CROSS REFERENCE TO RELATED APPLICATION

This application is a continuation-in-part of pending U.S. patent application Ser. No. 10/607,748, filed Jun. 27, 2003, now U.S. Pat. No. 7,441,379, which is incorporated herein by reference in its entirety.

FIELD OF THE INVENTION

This invention relates to a high performance architectural glazing panel system, glazing panels therefor and retention clips for retaining the glazing panels against separation particularly due to uplift loads from high velocity winds flowing over the glazing panels.

BACKGROUND OF THE INVENTION

As disclosed in U.S. Pat. Nos. 4,573,300 and 6,164,024, module glazing panels are used with a framing grid of purlins and rafters to form a wall, an overhead or roofing structure such as for skylights, covered walkways, pool enclosures, building atriums, greenhouses, etc. Glazing panels generally have light transmission properties to allow light to pass through the structure to illuminate interior regions covered by the glazing panels. The glazing panels disclosed in the above-identified patents as well as those made by other manufacturers are provided with upstanding seam flanges which extend along the side edges at the ends of the panels for being connected to one another with connectors. As disclosed in U.S. Pat. No. 4,573,300, the upstanding seam flanges were provided with projecting saw teeth and batten type joining connectors having internal saw teeth which were pushed down over the saw teeth on the seam flanges to snap fit the saw teeth together to join the adjacent panels by means of the batten only. U.S. Pat. No. 6,164,024 discloses the use of improved joining or retention clips made of metal which are used to join adjacent seam flanges together as well as cooperating with a batten which covers the seam flanges and clips. The retention clips have top flanges that provided the clip with improved holding power to hold the panels against becoming loose and sliding out from the glazing panel system during high wind loading of the glazing panel system. More specifically, high winds flowing across very large surfaces exert negative uplift forces on the panels which tend to separate the panels from one another and the retention clips as well as the battens are required to retain the glazing panel structure intact despite such forces. This vacuum or negative pressure caused by high winds flowing over the glazing panels with a pressurized interior of the building can cause the glazing panels to be pulled off unless the clips and panels are sufficiently strong to resist the forces being generated.

The glazing panels tend to bow upwardly under negative wind loads due to high velocity wind flow across the outer external major surfaces of the glazing panels. A positive air pressure on the interior surface also may contribute to this bowing of the glazing panels. Testing shows that as the adjacent glazing panels bow, the lower interior ends of the glazing panels separate and form a larger gap therebetween. In the glazing panel systems without a retention clip, the enlarging space between these lower interior ends of the glazing panels tends to break the engagement of the toothed surfaces on the upstanding seam flanges and depending legs of the inverted channel seam covering connector which covers the seam between adjacent panels. These uplift loads then tend to pop the U-shaped connector up as the teeth of the upstanding seam flanges separate from the teeth on the legs of the inverted channel connector.

When a retention clip is present as well as the inverted channel connector, as disclosed in U.S. Pat. No. 6,164,024, the top ends of the seam flanges pivot or hinge under the clip top flange as the panels increase in their amount of bowing and the gap at the lower ends of the panels increases due to increase bowing of the panels. The angle defined between adjacent upstanding seam flanges hinged at their upper ends increases with increased bowing of panels and also the gap increases between lower interior ends of the glazing panels. At sufficiently high uplift loads, e.g., exceeding that for which the glazing panel system is rated, the outer connector may flex outwardly and then separate its teeth from the teeth on the upstanding seam flanges resulting in the seam covering connectors being disconnected from the seam flanges and the upper ends of the glazing panels sliding outwardly from the top flanges of the retention clips. Thus, at loads greater than that for which the glazing panel system is rated, the glazing panels separate and may be lifted from the purlins and rafters resulting in a failure of the glazing panel retention systems.

Various codes have been adapted, particularly in hurricane designated areas, to subject windows, skylights and other glazing panel systems to uplift loads and negative forces which might be encountered during a hurricane or the like. One such standard is South Florida Building Code (SFBC). United Laboratories Standard "UAL 580" sets forth three different standards or ratings for glazing panel systems of 90, 60 and 30. To meet the UAL 580 standard or rating 90 the glazing panels are subjected and must resist an uplift wind load of 105 pounds per square foot (psf). For the UAL 580 standard 60, the glazing panel system must resist an uplift load of 75 psf. The UAL 580 standard 30 tests the glazing panel systems with an uplift load of 45 psf. Manifestly the present invention is not limited to any particular standard but these standards are set forth only by way of example; other standards that are currently use such as those set forth by the American Society of Civil Engineers, ASCE-7, ASTME 1996 and IBC.

SUMMARY OF THE INVENTION

In accordance with the embodiments, there is provided a new and improved, as contrasted to the prior art, glazing panel systems, glazing panels and retention clips for the glazing panels. This is achieved in the embodiments by lowering the hinge point of engagement of the retention clip from that heretofore used and/or providing an internal connector engaging the upstanding seam flanges in addition to the external connector.

In the embodiment having two connectors, the internal connector cooperates with the clip connector to hold the panels together and thereby decrease the gap between lower internal ends of the seam flanges as compared to the conventional retention systems that lack an internal as well as external connector. In those embodiments, which may lack the internal connector, the lowering of the hinge point also results in an improved retention of the external connector and a decrease in the gap between adjacent interior glazing panel ends as compared to the higher hinge points of the conventional systems having a retention clip.

When using a combination of internal and external connectors, the internal connector may be made stronger than the external connectors that it may better resist bending and flexing thereof with high uplift loads as compared to the external connector. The internal connector may also be made with a tolerance that allows the connected upstanding seam flange to expand with increases in temperature of the glazing panel which expands at a rate corresponding to its coefficient of expansion. The external connector may have less tolerance between it and its connected seam flanges, and because it is more flexible, the legs of the external connector may flex with expansion of the glazing panels under increasing temperatures being applied to the glazing panels. This tighter connection between the seam flanges and the flexible portions of the external connector allows expansion and contraction of the glazing panel while at the same time providing a weatherproof function while the less tight internal connector is performing its function of resisting uplift loads without having to perform the weatherproofing function of the external connector. The dual connectors each cover the seam between seam flanges to provide a good waterproofing of the seam to water trying to infiltrate through the seam. Thus, the use of internal and external connectors allows separation of the primary functions of weatherproofing the seam and retention of the panels under high uplift loads.

In the embodiment illustrated herein, the internal and external connectors are preferably formed in the shape of inverted channels and are made of plastic, although the internal and external connectors may be made of metal, if so desired. These inverted channel connectors each have legs that have teeth or steps thereon that have toothed engagement with spaced steps or teeth on the upstanding seams.

In accordance with a further embodiment, clip receiving receivers or pockets are formed in the panel end walls adjacent the base of the upstanding seam flanges to receive a transverse portion of the retention clip at a location below the upper ends of the seam flanges. It is the common practice today to have the clips engage the top ends of the seam flanges when using glazing panel systems of this kind. The preferred clip receivers are in the form of extruded clip receiving pockets formed in the extruded glazing panels adjacent the base of the upstanding seam flanges which receive an upper transverse flange portion of the retention clip to apply retention forces directly at the panel end walls rather than applying forces to the upper ends of the seam flanges.

Also, in accordance with this embodiment that does not have an interior connector, inverted channel connector covering the retention clip serves primarily the function of providing a weatherproof joint with the primary holding power for the resisting of uplift loads being provided by the retention clips located in clip receiving pockets that do not apply their retention force directly to the top end walls of upstanding seam flanges, but rather apply the retention force to panel ends adjacent the base of the seam flanges. In these embodiments, the retention clips are applying forces either directly into the end walls of the glazing panels, at the tops of the surfaces of the end walls of the glazing panels or to upstanding portions formed on the glazing panels at locations adjacent the seam flanges. As stated above, the uplift loads applied by high velocity winds flowing over the glazing panels are applied in generally diagonal direction to the vertical and horizontal and these loads attempt to bow and to slide the glazing panel ends along a diagonal path to separate from the retention clip. That is, the hinging point at which the seam flanges pivot is lowered in these embodiments as compared to the conventional hinge point at the top ends of tall seam flanges resulting in a smaller gap between the adjacent lower ends of the adjacent glazing panels being retained by the retention clip. The upstanding seam flange and the exterior U-connector leg, flex jointly and in concert resulting in improved retention. Thus, it is preferred to lower the hinge point and decrease the gap between adjacent lower panel ends for a given amount of curvature of the glazing panels under high uplift loads. This provides an improved retention force to resist the diagonal shifting of the panel ends from the retention clips and thus to meet the more regular standards of UAL 90, 60 or 30.

In one embodiment, the glazing panels are formed with pockets which are formed to conform to and receive therein the upper flange or projecting portion to resist the uplift loads. For example, in this one embodiment the panels are formed at their ends with receiving pockets for receiving a depending flange portion of the top flange of the retention clip with upstanding projections on the glazing panel extending parallel to the retention flanges being positioned to resist forces trying to shift the lower panel ends to form a gap therebetween during uplift loading due to high wind velocity flow across the surface of the glazing panels. Thus, rather than having the planar panel ends shown in the U.S. Pat. No. 4,573,300, in these embodiments, the glazing panels have specially configured retention clip receiving pockets formed at the panel end walls between the upstanding seam flanges.

In still another embodiment, the glazing panel pockets extend transversely inwardly directly from the end wall and into the ribbed supporting structure, between the top and bottom planar exterior and interior surfaces. These pockets extend transversely within the ribbed structure and may have enlarged hollow pocket end portions such as of circular cross-section with pockets disposed interiorly of the end wall so that a transverse extending clip flange having enlarged knobs or ends in cross-section may be pushed into the pockets to provide holding force at a location below the top major surface of the glazing panels. The upstanding seam flanges are, of course, located and project upwardly of the top major surfaces of glazing panel. If desired, an additional top flange may be provided on the retention clip to extend upwardly to and engage with the tops of the seam flanges in addition to the principal lower retention clip portion positioned in pockets intermediate the upper and lower major surfaces of the glazing panels.

In accordance with embodiments disclosed herein, the panel ends may be joined and the seam flanges spaced from one another with the panel ends joined by clip connectors in a manner that the seam flanges are not abutting one another. This allows the seam flange and the U-connector to flex jointly, at similar angles, resulting in improved retention under increased loads.

BRIEF DESCRIPTION OF THE DRAWINGS

FIG. 1 is a cross-sectional view of a glazing panel system in accordance with an embodiment having an internal and exterior connector;

FIG. 2 is a cross-sectional view of a glazing panel system in accordance with an embodiment and an internal and exterior connector with a retention clip having a tall central web;

FIG. 3*a* illustrates another embodiment having dual connectors;

FIG. 4 is a cross-sectional view in accordance with another embodiment;

FIG. 5 is a fragmentary view of vertically spaced teeth or steps on an upstanding seam flange;

DETAILED DESCRIPTION OF THE PREFERRED EMBODIMENTS

Figure 3:
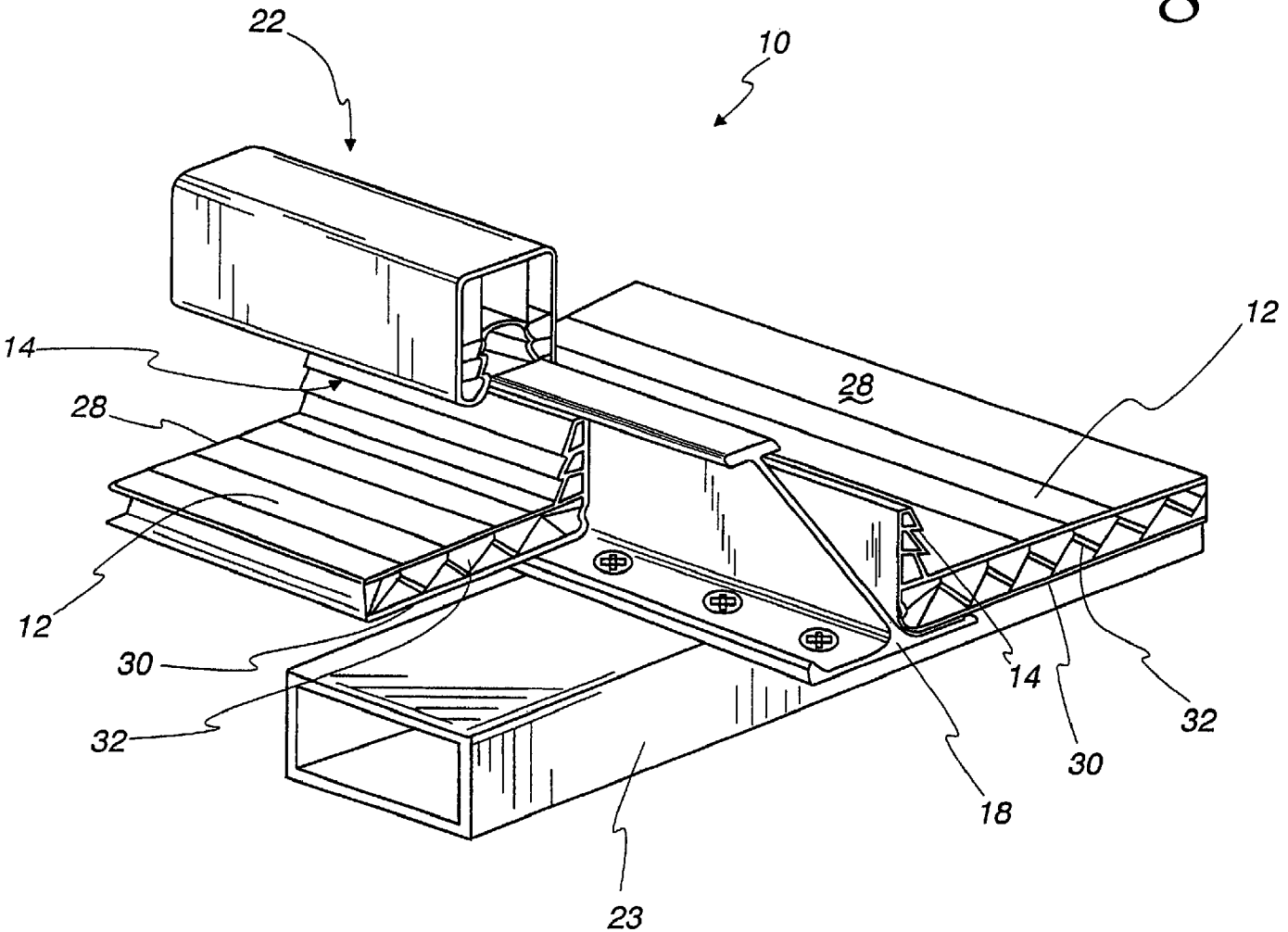
FIG. 3 is a cross-sectional view of a glazing panel system in accordance with another embodiment having a top flange of the retention clip at the top sheet surface of the glazing panel.

As is shown in the drawings for purposes of illustration, a glazing panel system 10 is shown in FIG. 3 as including modular extruded, glazing panels 12 that have a generally rectangular shape with upstanding projecting seam flanges 14 extending on either side of the glazing panels along their length. The preferred panel members 12 are preferably extruded and are formed with upper and lower sheets or surfaces 28 and 30 which are connected by an internal supporting structure which is shown herein in the form of ribs 32 but may have other shapes as disclosed in the aforementioned patents. Alternatively, solid plastic panel members having a solid plastic cross-section without any interior spaces or ribs may be used. The ribs 32 extend transverse to the flat sheets 28 and 30. The glazing panels are made of materials that allow light transmission therethrough such as transparent or translucent plastics, although the plastics could be opaque colored or otherwise tinted. The upstanding seam flanges on the panels extend substantially perpendicular to the upper and lower sheets 28 and 30 along the ends of the panels. Often the panels 12 are approximately 2 feet to 4 feet in width and can have a length of up to 60 feet. It will be recognized that other sizes and forms of panels with associated seam flanges can be used and fall within the purview of the present invention. The panels are made with upstanding seam flanges positioned adjacent one another in a parallel relationship forming a seam between adjacent panels which is covered and made waterproof by a connecting batten or outer connector 22 which is preferably snap fitted over the seam flanges to cover the seams formed therebetween.

Figure 7A:
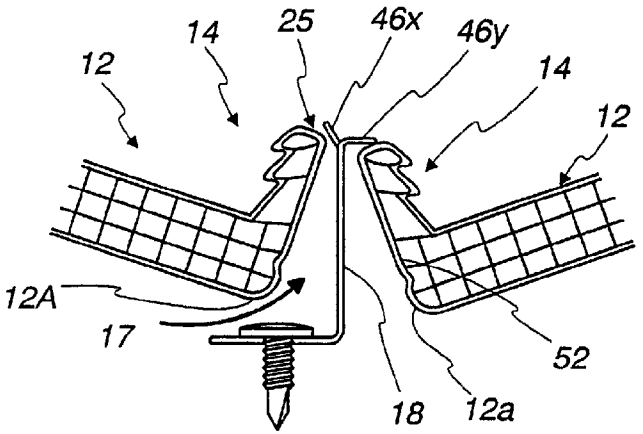
Fig. 7A (prior art)
FIG. 7A is a cross-sectional view of a sheet metal prior art clip with a left portion of the top flange of the retention clip being bent upwardly by the seam flange of the glazing panel.
Figure 7B:
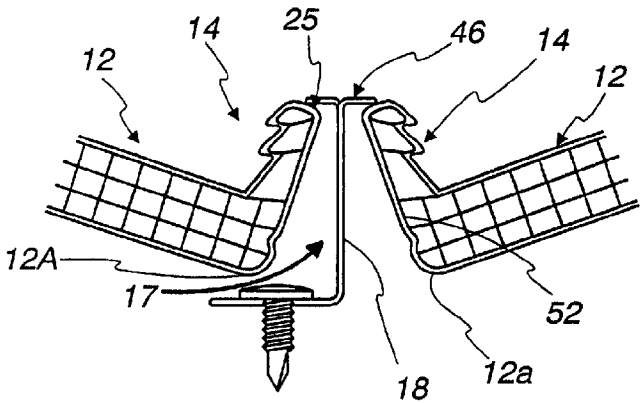
Fig. 7B (prior art)
FIG. 7B shows the prior art retention clip of FIGS. 7A and 7C.
Figure 13:
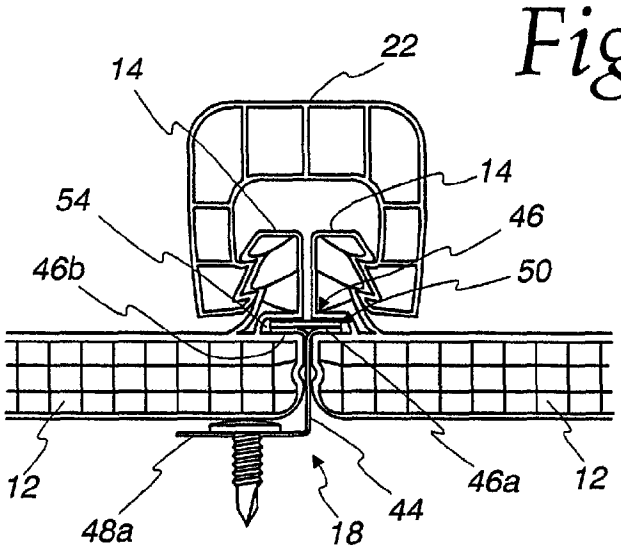
FIG. 13 is a cross-sectional view of a bent metal form of retention clip positioned similarly to the position of the retention clip made of extruded metal shown in FIG. 8.
Figure 14:
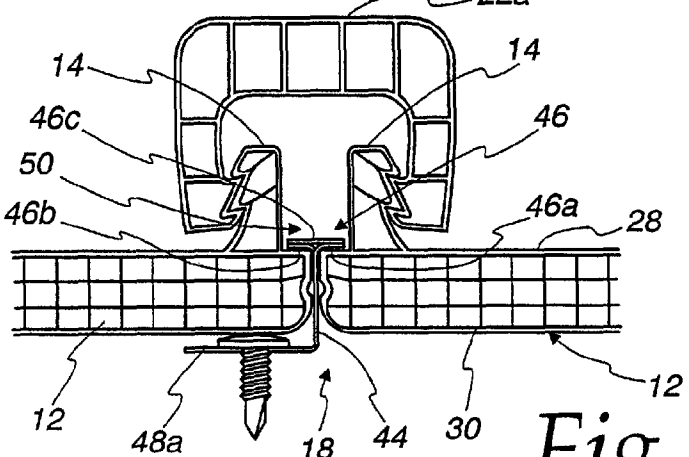
FIG. 14 is a cross-sectional view of a glazing panel system having a retention clip formed of bent sheet metal and positioned at the ends of the glazing panels generally in accordance with the extruded metal retention clip shown in FIG. 11.

A number of prior art retention clips have been used to retain the glazing panels connected to the supporting purlins and rafters so that the glazing panels maintain the roof's integrity despite the application of high velocity winds across the surface of the roof. With high velocity winds and particularly with hurricane-type high velocity winds, the large surface area of the top surface of the glazing panels results in large uplift loads being applied to the glazing panels that bow and tend to bend the small bent flanges on the retaining clips as illustrated in FIG. 13 in U.S. Pat. No. 6,164,024. In that patent improved stronger retention clips were formed and disclosed, see for example, FIG. 3 of the U.S. Pat. No. 6,164,024 patent wherein a top flange 46 on the retention clip overlies the tops of the seam flanges and a retention clip has a base flange 48 which is secured by a fastener 52 to a purlin 24. One problem with the systems described in the aforementioned patents, U.S. Pat. Nos. 4,573,300 and 6,164,024, is that the application of the restraining force holding the glazing panel down is at a high location at the top of the upstanding seam flange and is not adjacent the base of the seam flange. This results in a hinge point located higher and a larger gap between the lower corners of adjacent glazing panels, as explained above. During sufficiently high velocity winds, the glazing panel which is flexible and made of plastic bows in the center between the opposite seam flanges and the seam flanges tend to move outwardly with a force being exerted at an acute angle between the vertical and horizontal which is pulling the seam flanges outwardly from the retention clip causing the pivoting at the hinge point and a large gap between adjacent lower corners of adjacent glazing panels. Also, at this time, the integrity of the clips and the inverted U-connectors may be adversely affected, e.g., a left hand portion 46*x* of the prior retention clip shown in FIGS. 7A-7C may be bent upwardly from its horizontal position (FIG. 7B) to be inclined, as shown in FIG. 7A which allows the left clamping panel to be extracted.

Figures 6, 7:
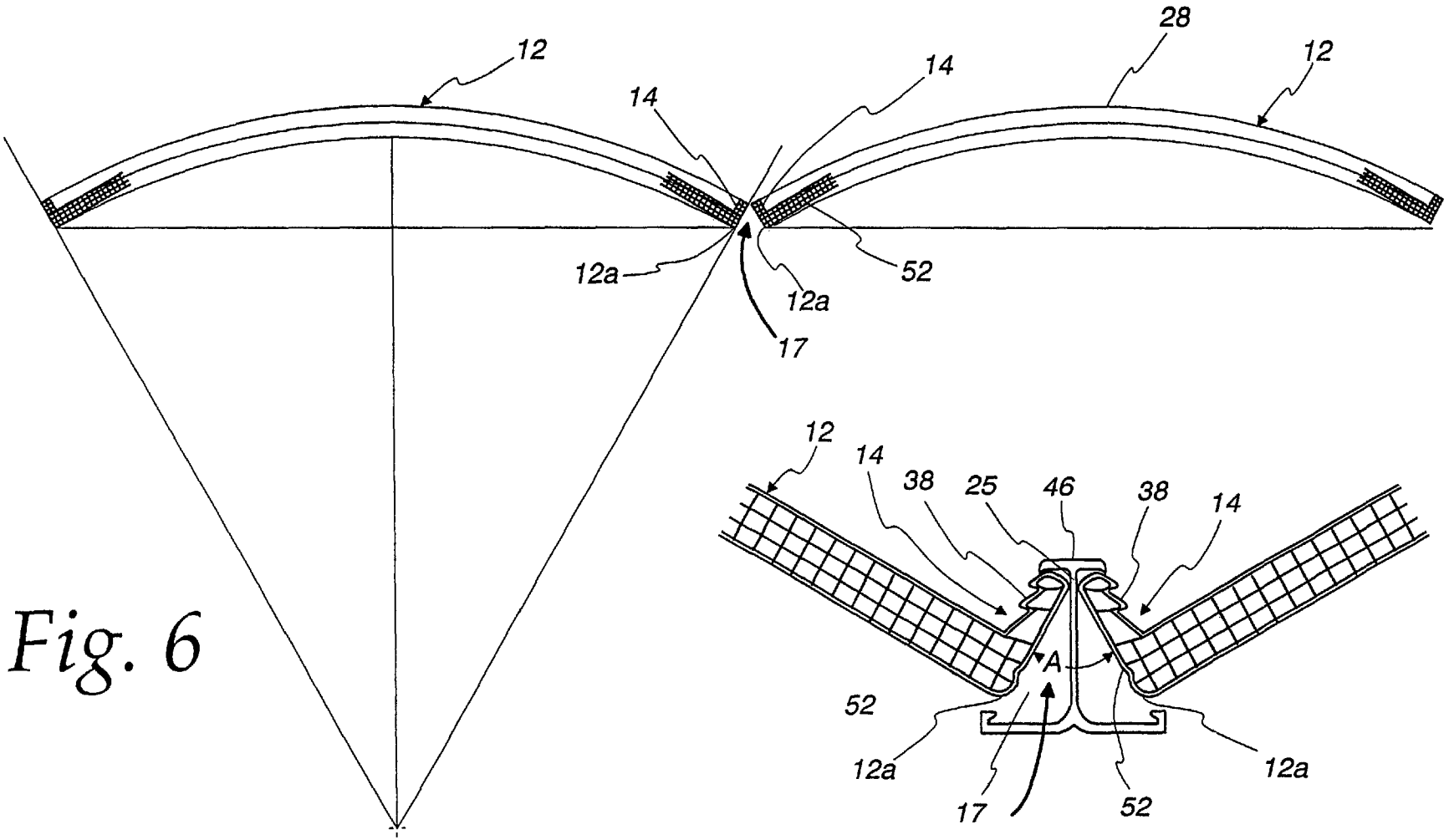
Fig. 7 (prior art)
FIG. 6 is a diagrammatic view of glazing panels bowed by negative uplift loads creating a gap between the lower corners thereof.
FIG. 7 is an enlarged, fragmentary cross-sectional view if the prior art construction in which adjacent lower corners of the seam flanges are pivoting about their upper ends at the underside of the top flange and creating the gap.

As seen in FIGS. 6-7, the glazing panels tend to bow upwardly under negative wind loads due to high velocity wind flow across the outer external major surfaces 28 of the glazing panels. A positive air pressure on the interior surface also may contribute to this bowing of the glazing panels. As the adjacent glazing panels bow, the lower interior ends 12*a* of the glazing panels 12 separate and form a larger gap 17 therebetween. In the glazing panel systems without a retention clip, as in U.S. Pat. No. 4,573,300, the enlarging gap 17 between these lower interior ends 12*a* of the glazing panels tends to break the engagement of toothed surfaces 38, 40 on the upstanding seam flanges and depending legs of the inverted channel seam covering connector which covers the seam between adjacent panels. These uplift loads then tend to pop this external U-shaped connector up as the teeth of the upstanding seam flanges separate from the teeth on the legs of the inverted channel connector.

When a retention clip is present as well as the inverted channel connector 22, the top ends 15 of the seam flanges 14 pivot or hinge at a hinge point 25 under the clip top flange 46 as the panels increase in their amount of bowing and the gap 17 between the lower ends 12*a* of the panels increases due to increase bowing of the panels. The angle A (FIG. 7) defined between adjacent upstanding seam flanges 14 hinged at their upper ends at hinge point 25 increases with increased bowing of panels and also the gap 17 increases between lower interior ends of the glazing panels. At sufficiently high uplift loads, e.g., exceeding that for which the glazing panel system is rated, the outer batten connector separates its teeth 38 from the teeth on the upstanding seam flanges resulting in the seam covering, batten connector being disconnected from the seam flanges and the upper ends of the glazing panels sliding outwardly from the top flanges of the retention clips. Thus, at loads greater than that for which the glazing panel system is rated, the glazing panels separate and may be lifted from the purlins 24 and rafters resulting in a failure of the glazing panel retention systems.

Turning now to the embodiment illustrated in FIGS. 1-4, an internal connector 20 and external connector 22 are provided with the internal connector cooperating with the clip connector 18 to hold the panels 12 together and thereby decrease the gap 17 between lower internal ends 12*a* of the panels as compared to the conventional retention systems that lack an internal connector.

When using a combination of internal and external connectors, the internal connector 20 may be made stronger than the external connector 22 so that it may better resist bending and flexing thereof with high uplift loads as compared to the external connector. The internal connector may also be made with a tolerance that allows the connected upstanding seam flange 14 and panel 12 to expand with increases in temperature of the glazing panel which expands at a rate corresponding to its coefficient of expansion. The external connector 22 may have less tolerance between it and its connected portion of the seam flanges, and because legs 22*a* of the external connector 22 may flex with expansion of the glazing panels under increasing temperatures being applied to the glazing panels. This tighter connection between the seam flanges and the flexible portion legs 22*a* of the external connector allows expansion and contraction of the glazing panel while at the same time providing a weatherproof function while the less tight internal connector 20 is performing its function of resisting uplift loads without having to perform the weatherproofing function of the external connector. The dual connectors 20, 22 each cover the seam between seam flanges to provide a good waterproofing of the seam to water trying to infiltrate through the seam. Thus, the use of internal and external connectors allows separation of the primary functions of weatherproofing the seam and retention of the panels under high uplift loads.

In the embodiment illustrated in FIGS. 1-4, the internal and external connectors 20, 22 are each preferably formed in the shape of inverted channels and are made of plastic. On the other hand, either the external connector or the internal connector may be made of metal. Of course, both connectors may be made of metal, if it is desirable. These inverted channel connectors each have depending legs 20*a*, 22*a* that have teeth or steps thereon that have toothed engagement with spaced steps or teeth on the upstanding seams.

More specifically, the inverted internal channel 20 has a pair of depending legs 20*a* with teeth or connecting steps thereon 20*b* for connection with a first set of seam teeth 42; and the external connector 22 has a pair of depending legs 22*a* with teeth or steps 40 thereon for connection with a second set of teeth 42 on the seam flanges 14. In the FIG. 2 embodiment, the seam flange has first or lower teeth 42*a* and second or upper teeth 42*b* with the upper teeth 42*b* interlocking with the teeth 20*b* on the internal connector 20 and with the lower teeth 40 cooperating with the lower teeth 42*a* of the seam flange.

In the embodiment of FIG. 2, the respective seam flange teeth 42*a*, 42*b* are separated vertically (FIG. 5) while in the embodiment of FIG. 1, the respective seam flange teeth 42*a*, 42*b* are separated horizontally. In FIG. 1, the upstanding seam flange 14 is separated into two portions 14*a* and 14*b* whereas the seam flange 14 in FIG. 2 has only a single portion. In the embodiment of FIG. 1, the hinge point 25 is lower, that is closer to the upper major sheet 28 of the glazing panel 12, than is the hinge point 25 in the FIG. 2 embodiment which is beneath the upper flange 46 and locate adjacent the higher central web 44 of the clip 18. It is usually desired to have a smaller width, as shown by the smaller cross-section for the outer connector 22 in FIG. 2 as contrasted to the wider width and cross-section for the outer connector shown in FIG. 1.

Turning now to the FIG. 3*a* embodiment, it has two seam portions 14*a* and 14*b*, each having teeth 42*a* and 42*b* thereon with the two seam portions 14*a* and 14*b* joined by an integral horizontal web portion 14*c* of the seam flange 14. An inverted channel-shaped, interior connector 20 has its teeth 20*b* for cooperating with the teeth 42*b* on the seam flange.

The hinge point 25 is lower in the FIGS. 3A and 4 embodiments, than is the hinge point 25 in the FIGS. 1 and 2 embodiments because the top flange 46 of the retention clip 18 is lower and is at the plane of the top sheets 28 of the glazing panels 12. In FIGS. 3A and 4, the top flange is positioned in a clip receiver 50 in the form of a pocket which is defined in the top sheet 28 and the horizontal seam web 14*c* positioned over the top of the top flange 46 of the retention clip. The advantages of having a clip receiver pocket 54 for the top flange 46 will be explained in greater detail hereinafter.

Figure 8:
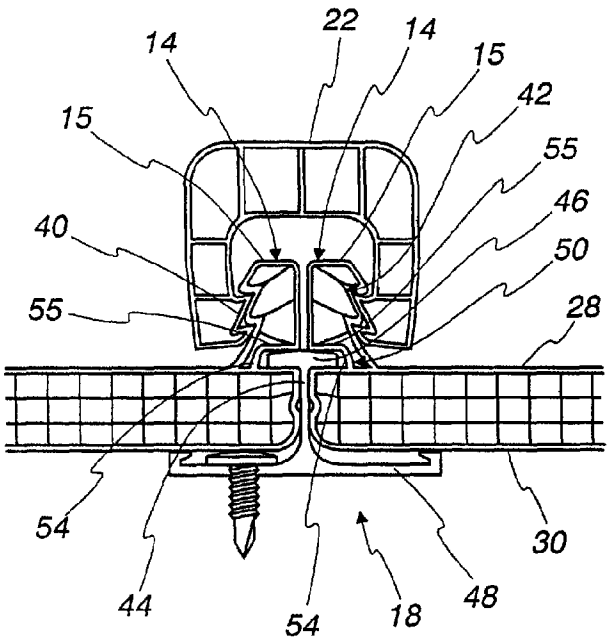
FIG. 8 is a cross-sectional view of an assembled glazing panel system in accordance with an embodiment showing a retention clip positioned within a clip receiver formed in the end of the respective glazing panels adjacent the base of the upstanding seam flanges.
Figure 21:
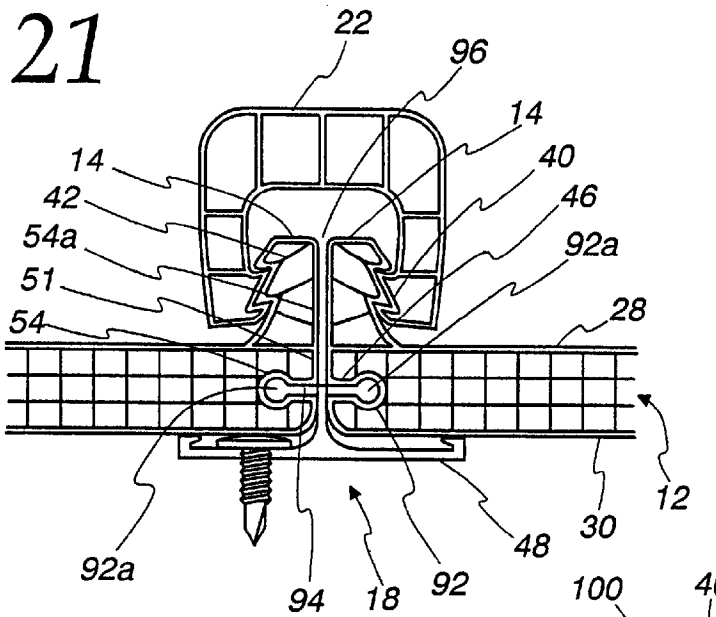
FIG. 21 is a cross-sectional view of another embodiment having a retention clip with an upper flange having enlarged, transverse end portions extending into pockets formed within the end walls of the glazing panels at locations between the upper and lower major, sheet surfaces of the end panels.

In accordance with an embodiment disclosed herein in FIG. 8, the top flange 46 of the retention clip 18 is located more closely adjacent to and preferably at the base of the seam flanges 14. In other instances, such as illustrated in FIG. 21 the top flange is actually below the seam flanges 14 such that the resistance to the upward pull is at a location that is not affected by the bowing or the flexing of the top portion of the seam flange as in the current prior art glazing panel systems. Also, by lowering the position of the top flange of the connector clip, as shown, e.g., in FIGS. 8, 9 and 21, the connector clip can be used to perform primarily or solely the mechanical inner connection between the panels with the batten performing primarily a seam covering function.

Referring now in greater detail to illustrated embodiments of the retention clips 18. For example, as shown in FIG. 8 the retention clip 18 is shown with a top flange 46 which is received in a clip receiver 50 formed in the end of the panel adjacent the bottom of the upstanding seam flanges 14. More specifically, the clip receiver 50 is disposed at the base of the respective upstanding seam flanges of the adjacent glazing panels 12, as shown in FIG. 8, with the retention clip having a web portion 44 which substantially matches the height of vertical end walls 52 of the respective glazing panels 12. The clip's top flange is received in the clip receivers 50 which in FIG. 8 are in the form of pockets 54 adapted to receive the respective left and right-hand ends of the top flange. In FIGS. 8 and 13, the receiver pockets 54 are formed by a upper horizontal wall 55 formed to extend substantially horizontally adjacent the base of the upstanding seam flange 14 and spaced above the end of the top sheet 28. The top sheet 28 forms the bottom of the pocket 54 adjacent a corner 56 between the top sheet 28 and the vertical end wall 52 of the glazing panels. Thus, it will be seen that the mechanical retention force being applied by the clip top flange 46 to the glazing panel to resist the uplift load is applied at a much lower position and within a pocket rather than being merely disposed over top end walls 15 of the seam flanges 14 as in prior art systems. In this connection, the batten 22 with its saw teeth 40 engaging the saw teeth 42 of the upstanding seam flanges 14 serves mainly as a weather protector to cover the seam between adjacent ends of the glazing panels. Although the batten and its saw teeth 40 provide some resistance to glazing panel separation at high uplift loads in the embodiments of FIGS. 8-14, the primary retention of the glazing panels is due to the retention clip top flange 46 being a pocket 54 at the base of the seam flanges.

Additionally, when the top flange 46 engages the top ends 15 of the seam flanges and panels hinge as seen in FIG. 6, the legs 22*a* of the connector 22 bend outwardly away at different angles, each tending to loosen the toothed engagement with the teeth on the seam flanges 14. On the other hand, when the clip is lowered to a position, e.g., at the level of the top sheets 28 of the glazing panels, the upstanding seam flanges 14 tend to have their upper ends 15 pivot toward one another as indicated by the arrows B in FIG. 11, because these ends are on the opposite sides of the hinge point 25, i.e., above the hinge point 25. Thus, the teeth on the exterior connector will remain engaged to also provide better retention of the seam flanges than when the hinge point 25 is higher.

Figure 11:
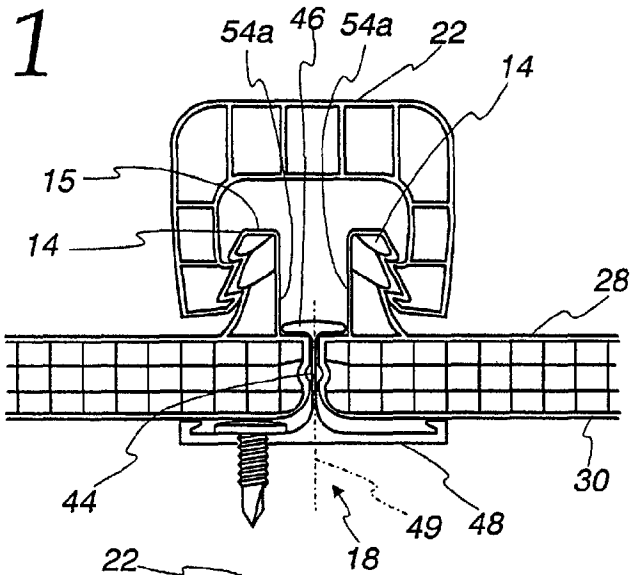
FIG. 11 is a cross-sectional view of another embodiment having a retention clip similar to the retention clip of FIG. 8 but positioned differently with respect to the ends of the glazing panels.

In the embodiment shown in FIG. 11, the retention clip 18 is the same as the retention clip 18 used in FIG. 8, but the clip receiver 50 in FIG. 11 comprises the top surfaces of the upper sheets 28 and adjacent lower ends of upstanding inner vertical side walls 54*a* of the respective seam flanges 14. Architects may prefer a narrower seam batten 22 as shown in FIGS. 8 and 13 as compared to the wider seam batten 22 shown in FIGS. 9 and 11 wherein the seam flanges 14 are separated by the width of the top flange 46 of the retention clip 18. That is, in FIG. 11, the seam flanges 14 have their inner seam flange walls 54*a* separated from one another by a width or spacing equal to the width of the top flange 46 of the retention clip 18, which is not the case in the FIGS. 8 and 13 embodiments.

The retention clips illustrated in FIGS. 8 and 11 are made of extruded metal, for example, aluminum with a one-piece body and are symmetrical in cross-section about a vertical axis 49 (FIG. 11) through the central web 44 of the retention clip. However, the retention clips 18*a* of the embodiment shown in FIGS. 10 and 13-16 are made of bent sheet metal and are illustrated with only a single leftward extending bottom flange portion 48*a* rather left and right extending portions (FIGS. 8 and 11) to be connected to a purlin or other supporting structure. The sheet metal bent retention clip 18 shown in FIGS. 13 and 14 each have a bent left, upper portion 46*x* for a top flange and a right portion 46*y* bent in the manner of the prior art connector shown in FIGS. 7A-7C except that an additional plate 46*c* is disposed over the top of the respective left and right bent portions 46*x* and 46*y* and is welded thereto to provide a double ply thickness to provide additional strength to resist bending of the upper composite flange and thereby to retain the seam flange against the uplift loads across the entire width and length of the top flange. That is, the top plate 46*c* prevents the upward bending of the underlying bent top flange portion 46*x* and 46*y*. As is illustrated and described in connection with FIGS. 7A-7C, the illustrated clips in FIGS. 13 and 14 only have a leftwardly extending base flange 48*a* and, therefore, are not symmetrical about a vertical axis 39 through the vertical web 44 as a web clips 18 illustrated in FIGS. 8 and 11. On the other hand, these sheet metal bent retention clips may also be bent to have left and right base flanges to be fastened to a purlin with a fastener in the manner that the extruded base flange left and right portions and fastened by fasteners to the purlin. Thus, it will be seen that the retention clips may be provided of either sheet metal or extruded metal or may be either symmetrical or asymmetrical and fall within the purview of the appended claims.

Figure 7C:
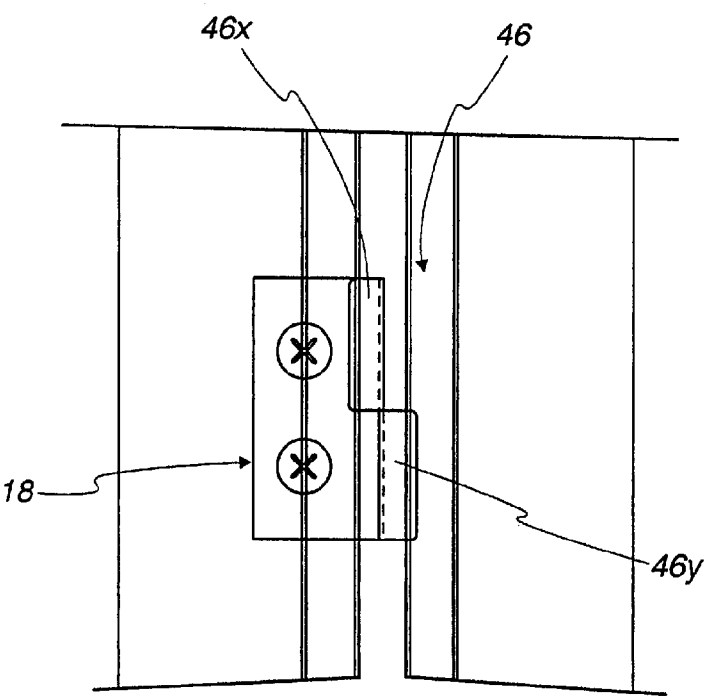
Fig. 7C (prior art)
FIG. 7C is a plan view of the prior art retention clip which is shown bent in FIG. 7A.
Figure 9:
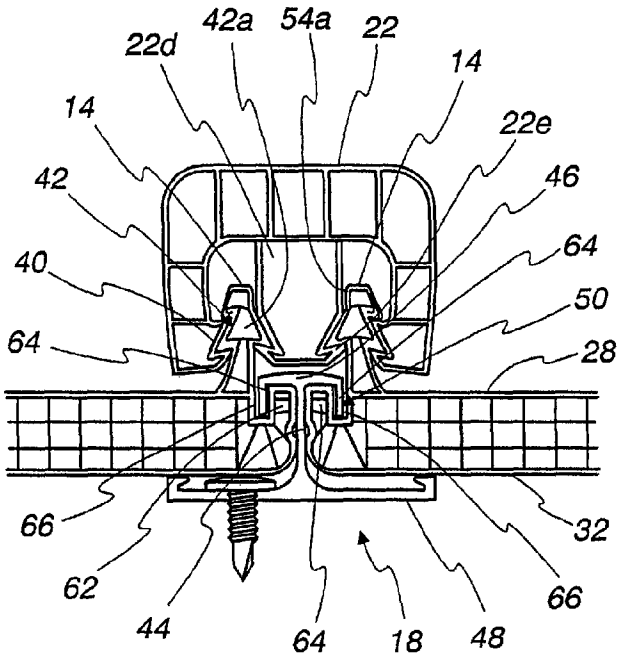
FIG. 9 is a cross-sectional view of an assembled glazing panel system having a retention clip having depending portions on its top flange and constructed in accordance with another embodiment.
Figure 12:
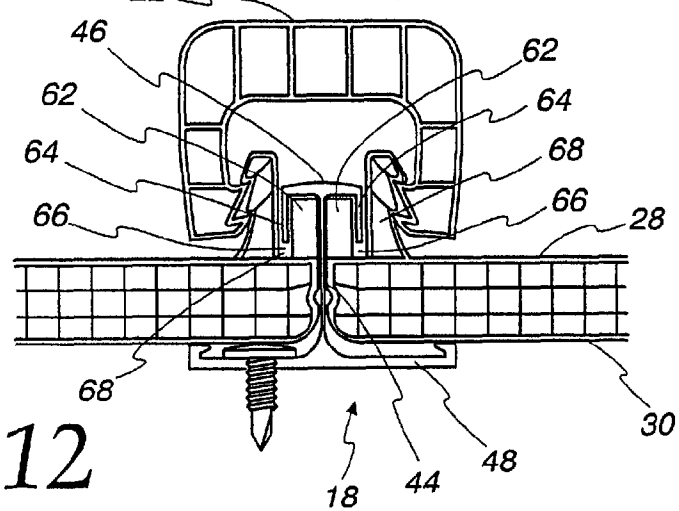
FIG. 12 is a cross-sectional view of an assembled glazing panel structure having a retention clip similar to that shown in FIG. 9 but disposed at a raised position over upstanding projection portions formed on the ends of the glazing panels at a location between the seam flanges.

Referring now to FIGS. 9 and 12 embodiments, the glazing panels 12 have the clip receiver 50 in the form of upstanding bars 62 and grooves 66 for cooperation with clip top flange 46 which has a pair of parallel, spaced depending portions 64 on the retention clip 18. More specifically as best seen in FIGS. 9 and 12 the upstanding bars 62 at the ends of the glazing panels may be either formed by the grooves or channels 66 (FIG. 9) in the top sheet 28 of the glazing panel or may be grooves 66 formed between seam flange vertical wall 54 and the bar 62 projecting upwardly above the top sheet 28 of the respective end panels. In the embodiment shown in FIG. 9 the respective grooves or channels 66 are formed at the base of the upstanding seam flanges 14 and extend into the panel to locations below the top sheet 28. The depending portions 64 on the clip extend downwardly and parallel to the central web portion 44 of the retention clip. That is, the depending portions 64 are preferably in the shape of depending flanges each of which is parallel to the central web portion 44 and extends the length of the retention clip. These depending portions 64 may be continuous flanges or they may be spaced, depending portions. Thus, it will be seen that the depending flanges within the grooves or channels 66 will also apply a holding force to resist hinging and separation of the glazing panel ends 12*a* to form a wide gap 17 therebetween as a high velocity wind flow across the top surfaces of the glazing panels 12 that bows the centers of the panels, as best seen in FIGS. 6 and 7-7C.

Figure 10:
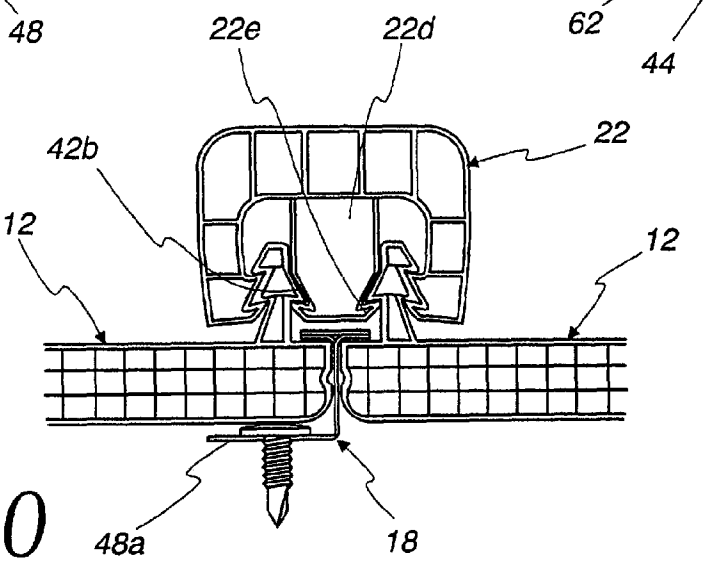
FIG. 10 is a perspective view of a glazing panel system in accordance with the embodiment of FIG. 8 showing an improved connector.

The external connector 22 shown in FIGS. 9 and 10 differs from the external connector 22 shown in FIG. 12 and that shown in FIG. 8 or FIG. 11 in that the external connector 22 has a depending central portion 22*d* in the form of a longitudinally extending bar that has saw teeth 22*e* at its lower portion for cooperating with an internal saw tooth 42*b* formed on the inner side walls 54*a* of the upstanding seam flanges 14. The seam flanges 14, illustrated in the embodiments of FIGS. 9 and 10; are also provided with the usual saw teeth 38 which cooperates with the usual batten saw tooth 40. Thus, the external connector 22 of FIG. 9 has inner and outer saw teeth 22*e* and 40 for cooperating with the inner and outer saw teeth on the seam flanges 14. The bottom wall of the batten central portion 22*d* is positioned just over the top flange 46 of the clip to hold the same in position. The depending portions 64 on clip are located in the grooves 66 and cooperate with the bars 62 on the glazing panels to hold the panels in position against oblique uplift loads due to high velocity winds.

Figure 15:
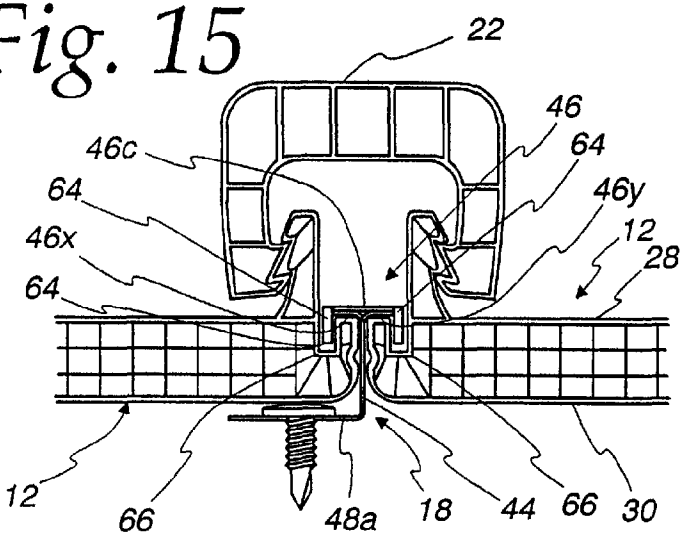
FIG. 15 is a cross-sectional view of a glazing panel system having a bent sheet metal retention clip positioned on the glazing panel ends in a manner similar to that shown in FIG. 9.

Turning now to the embodiment illustrated in FIG. 15, the batten connector 22 in the respective glazing panels 12 are the same as those used and described in FIG. 9 in that the ends of the panels have clip receivers 50 in the form of bars 62 and grooves 66 at the ends of the glazing panels 12. The grooves 66 define the outer vertical sides of the bars at the end of the glazing panels and the grooves receive the depending flange portions 64 which depend on both sides of the top flange 46 of the retention clip 18. The retention clip shown in FIG. 9 is shown to be made of extruded metal type of construction while the retention clip shown in FIG. 15 is made of bent metal, such as sheet metal, and has only a leftwardly extending base flange 48*a* for receiving the fastener which secures the same to the purlin or other underlying support. Herein the top flange 46 of the retention clip 18 shown in FIG. 15 is formed with a double metal thickness with the lower portion being integral with the central web 44*a* of the retention clip. That is the upper portion, for example one-half, of the integral part is attached to the central web 44*a* and is bent to the left and identified as portion 46*x* whereas the oppositely bent, half portion is identified as 46*y*. On top of those two left and right bent portions is a continuous, channel-shaped member which is inverted and welded to the top flange portion 46*x* and 46*y*. This inverted channel member has a central top flange strip 46*c* which is integral with the respective depending flanges 64 which are positioned in the grooves 66. The top flange strip 46*c* is welded or otherwise secured to the respective left and right bent portions 46*x* and 46*y* so as to make a common unified top flange 46 for the clip which will have increased strength over just having the left and right bent portions 46*x* and 46*y*. Thus in the manner described in connection with FIG. 9, the depending parallel flanges 64 are disposed in the respective grooves 66 for cooperating with the bars 62 and the ends of the respective glazing panels. This retention position for the clips is located at a very low position with respect to the tops of the seam flanges and provides a holding force at the base of the seam flanges resisting the hinging movement as would separate the ends 12*a* of the glazing panels from the retention clip 18 as during a high wind storm.

Figure 16:
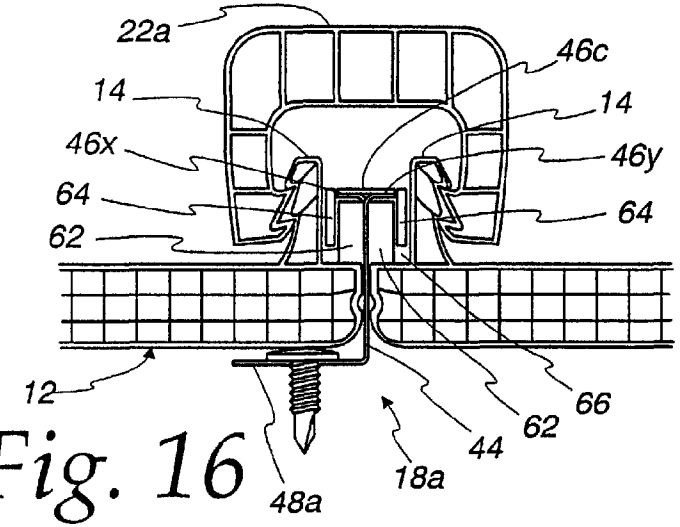
FIG. 16 is a cross-sectional view showing a bent sheet metal retention clip positioned in a manner similar to that of the extruded metal retention clip shown in FIG. 12.

The embodiment shown in FIG. 16 has the same glazing panels 12 as disclosed in FIG. 12, which have the upstanding bars 62 with the bars being located above the top surfaces 28 of the respective glazing panels 12 and at the ends thereof. The upstanding seam flanges 14 and the batten connector 22 are similar in FIGS. 12 and 16 so that the batten connector 22 forms primarily a weatherproof sealing function. Preferably, a strong retention gripping of the glazing panels to hold the same against uplift load forces is from the kind of clip 18 shown in FIGS. 12 and 16. The clip 18 shown in FIG. 16 differs in that it is a bent metal clip whereas the clip illustrated in FIG. 12 is a extruded metal clip 18. The construction of the clip shown in FIG. 16 is similar to that shown in FIG. 15 in that the clip 18 is made of bent metal and has an inverted channel member positioned over the leg and right bent portions 46*x* and 46*y* and welded thereto to form the top flange 46 of the retention clip. The inverted channel member has parallel depending flange portions 64 disposed in the grooves 66 for cooperating with the upstanding bars 62. Thus, the bars 62 and the depending flanges 64 are located adjacent the base of the upstanding seam flanges 14 in FIG. 16 and with the top flange providing a resistance to hinging due to uplift loading forces on the glazing panels 12 as would release them from the retention by the clips 18. The clip 18 has only a single leftwardly extending leg 48*a* similar to that shown in FIG. 15 and described above.

Figure 17:
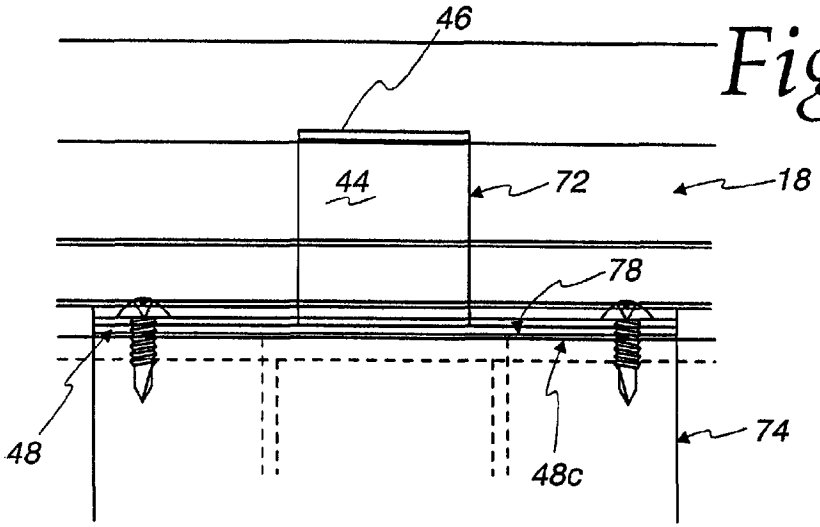
FIG. 17 is a side elevational view of a retention clip having a upper portion movable relative to a lower portion which is to be connected to a purlin.
Figure 18:
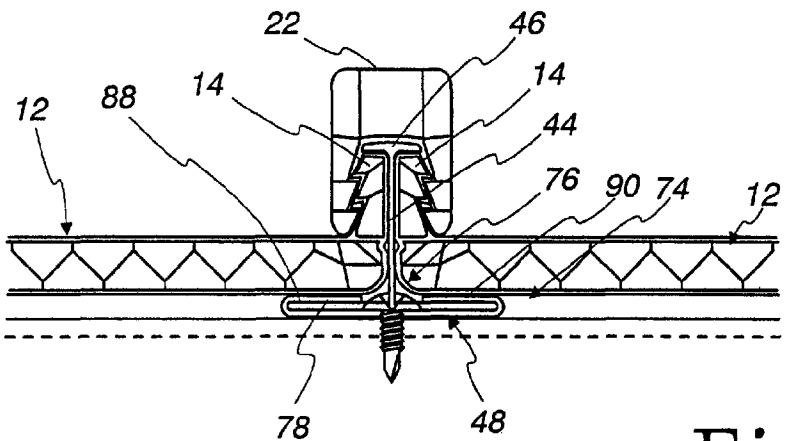
FIG. 18 is a cross-sectional view of an assembled glazing panel having the retention clip of FIG. 10 with the upper portion being movably mounted with respect to the lower portion.

Referring now to the embodiment of FIGS. 17 and 18, a problem with the glazing panel systems using the existing, conventional retention clips is that the wide expanses of the glazing panel surfaces are exposed to sunlight or internal heating which can expand the glazing panels and to cold weather which can contract the same when they are subjected to extreme cold. The glazing panels depending upon their construction and kind of plastic, will each have a coefficient of expansion. If the expansion is large due to high temperature exposure, there is a tendency for the glazing panels to rub edges against one another or against the webs of the retention clips. It should be remembered that the glazing panels 12 can be extremely long in length as well as relatively wide in width. To accommodate such contraction and extraction, there is provided a new and improved retention clip 18 which is illustrated in the embodiment of FIGS. 17 and 18 as having an upper slidable portion 72 which is slidably mounted to slide relative to a lower fixed portion 74 which is fastened to a purlin or the like or supporting structure by the usual fasteners. A slidable inner connection 76 is formed between the respective upper slidable portions 72 and the lower fixed portions 74 and may take different forms as will be described hereinafter in conjunction with other embodiments. Herein the slidable inner connection 76 is provided with a slidable inner connection portion 78 moveable in a slot 80 in the lower portions base flange 48.

In the embodiment shown in FIGS. 17 and 18, the slidable upper portion 72 has a slidable inner connection 76 with the lower fixed portion 74 of the clip in the form of a slidable, flat, horizontal web 88 fixed to the lower end of the upstanding central web 44 of the clip. The lower slidable base 88 is received within a base flange 48. It has a pair of in-turned end portions 89 and 90 which are parallel to a bottom portion 48*c* of the base flange between which they defined a space which allows the upstanding web 44 of the clip to be joined at its lower end to the horizontally extending, slidable base 88 as viewed in FIGS. 17 and 18. Thus, with expansion and contraction the upper portion 72 may move laterally with the web moving within the slot between the in-turned ends 89 and 90 of the fixed base flange 48. Manifestly, the upper end flange could be positioned as another embodiments described herein rather than being at the top of the upstanding seam flanges as illustrated in FIGS. 17 and 18.

Figure 20:
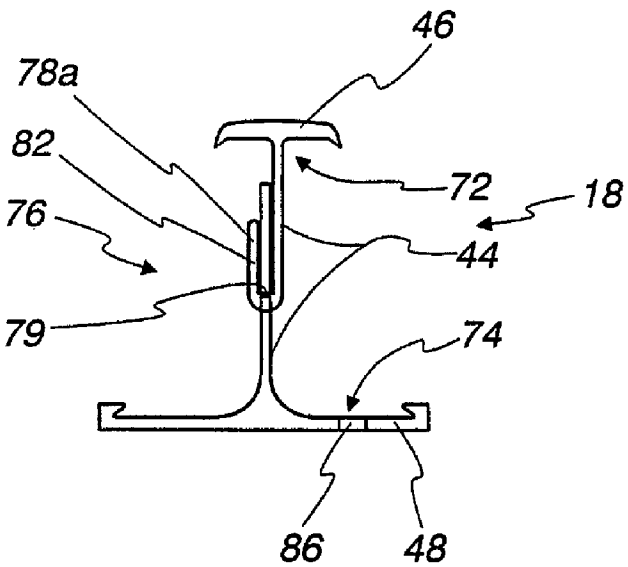
FIG. 20 is a cross-sectional view of a retention clip of FIG. 19 showing a bent end on the upper clip portion which is slidable within an elongated slot in the base portion of the retention clip.
Figure 19:
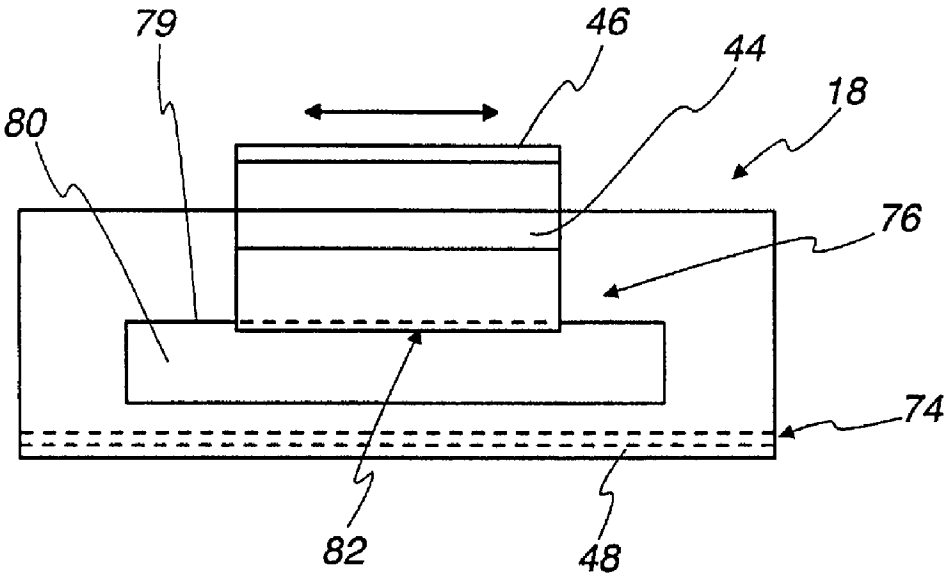
FIG. 19 is a side elevational view of another retention clip having a movable upper portion having a top flange slidable within a slot formed in a lower portion of a retention clip.

In the FIG. 19 and FIG. 20 embodiment the retention clip 18 is also provided an upper movable portion 72 slidable on a lower fixed portion 74. In this embodiment, the illustrated slidable inner connection portion 78 is provided with a hook 78*a* which will hook onto a top edge wall 79 (FIG. 19) defining the upper side of a slot 80 so as to slide to the left or right in this figure with expansion or contraction of the glazing panels. When there is an upward force on the glazing panel, it will be applied to the top flange 46 of the retention clip 18 as best seen in FIGS. 19 and 20. The preferred slidable inner connection 76 includes the U-shaped bent hooked portion 78*a* defined by an upper extending leg 82 on one side of portion 72 and a vertical web on the other side of the central portion of lower fixed web 44 of the clip. When an uplift load is applied to the top flange 46 of the retention clip shown in FIGS. 19 and 20, the uplifting force of the glazing panel against the top flange 46 exerts a force to pull the hook portion upwardly more tightly against the top edge 79 of the slot 80 in the low portion 74 of the clip which is fastened against moving upwardly at the base flange 48 by the usual fasteners. In the embodiment illustrated in FIGS. 19 and 20, the clip has an extruded upper slidable portion 72 and a lower fixed portion 74 which is also made of extruded metal. Manifestly, rather than have a double web flange extending to the right and left as shown in FIG. 19, there could but a single web extending, for example, to the right only. In the extruded flanges 48 of this type it is preferred to provide a opening 86 therein for receiving the fastener to fasten the clip 18 to the purlin. In the embodiments illustrated in FIGS. 17-20, the top flange 46 is positioned to engage the top of the upstanding seam flanges 14. Thus, the upper movable portion 72 of the clip thus is movable relative to the lower portion 74 with expansion and contraction of the glazing panel and has its top flange 46 positioned over the top of the upstanding seam flanges 14 of the glazing panel. Manifestly, the top flange 46 of the upper movable portion 72 may be positioned to engage the glazing panels 12 adjacent the base of the seam flanges as in the hereinbefore described embodiments.

Figure 22:
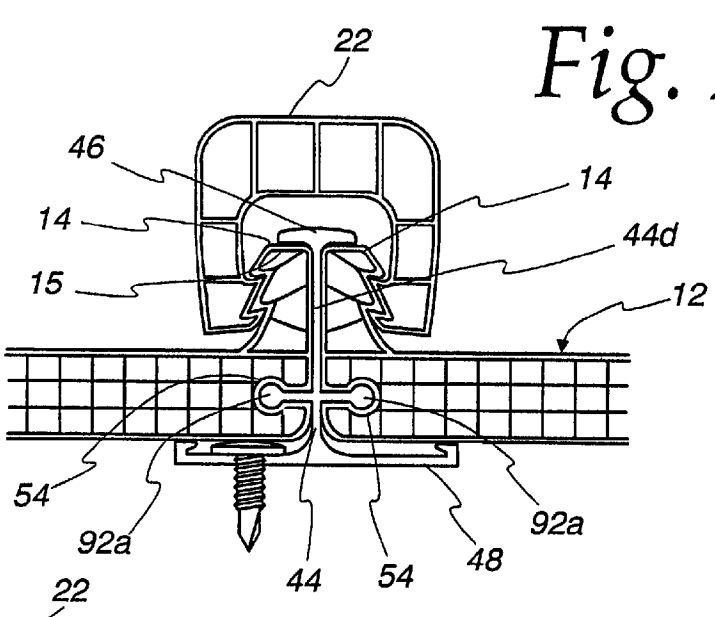
FIG. 22 is a view of another embodiment of the retention clip of FIG. 14 to which has been added an upstanding web upper portion having a top flange overlying the tops of the seam flanges.

In the embodiment illustrated in FIG. 21, the retention clip 18 is formed to cooperate with glazing panels 12 that have glazing panel pockets 54 extending transversely inwardly from the glazing panel end walls 51 in the glazing panel between the upper top sheet 28 and lower sheet 30. In FIGS. 21 and 22, the pockets 54 are illustrated as being formed in the internal rib structure 32, half way between the top sheet 28 and the lower sheet 30 of the glazing panel 12. In the embodiment illustrated in FIG. 21, the top flange 46 is provided with enlarged portions at the end thereof in the forms of knobs 92*a* in circular cross-section which are similarly shaped pockets 92 of circular cross-section to receive the enlarged knob therein to provide a holding force located within the central portion of the end walls 51 of the adjacent glazing panels and at a location between the top sheet 28 and the lower sheet 30 of the glazing panels 12. The top flange 46 extends horizontally and is parallel to the lower base flange 48 which can be secured by suitable fastener to a purlin. Thus, the positions of the top flange 46 within the clip receiver pockets 54 in the rib structure 32 provide a good holding power against the upward pulling movement due to the lifting force from high winds. The top flange 46 and the receiving pockets 54 are located adjacent the base of the upstanding seam flanges 14 which are covered by a exterior connector 22 which has the serrated teeth 40 for engaging with the serrated teeth 42 on the upstanding seam flanges 14 to provide a weatherproof inner connection. The embodiment illustrated in FIG. 21 is preferably made such that inner vertical end walls 54*a* of the seam flanges 14 provide a space 96 therebetween so that the facing end walls of the seam flanges do not rub against one another with expansion of the glazing panels.

In the embodiment of FIG. 22 the retention clip 18 has the same circular transverse cross-section enlarged knobs 92*a* disposed within receiving pockets 54 in the center of the panel extending horizontally inward from the ends of the respective glazing panels 12. Rather than having a space or gap 96 between the facing ends of the upstanding seam flanges and a upper half of the ends of a glazing panels 12, the embodiment of FIG. 22 has a retention clip 18 with a central web 44*d* which extends upwardly in through the space 96 and has at its upper end a top flange 46 which is in addition to the lower transverse flange with the knobs 92*a* thereon. Thus, during an uplifting load trying to pivot the panels apart at their hinge points 25, the ends of the glazing panels are held not only by the lower flange but also by the top flange 46 at the top of the web 44*d*. Thus, there is provided a holding force at the top of the seam flanges 14 as a holding force which is provided by the enlarged knob cross-section 92*a* on the lower flange. In the embodiments shown in FIGS. 21 and 22, the retention clip is an extruded aluminum or other metal material made of and the receiving pockets and grooves 92 are preformed into the end walls of the respective glazing panels to receive the enlarged knob portions 92*a*.

Figure 23:
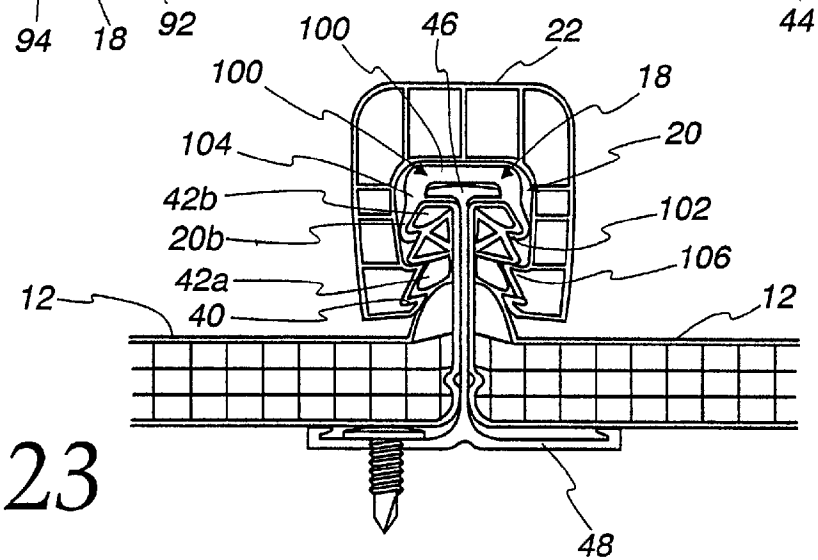
FIG. 23 is a view of another embodiment of the glazing panel having a retention clip system with an internal inverted U-channel connector for engaging the saw teeth of the seam flanges at a location above the top flange of the retention clip.

The embodiment shown in FIG. 23, has dual connectors 20 and 22 with the interior connector 20 being superimposed over the top of the top flange 46 of the retention clip 18 and applies substantial retention forces to the seam flanges. More specifically, the illustrated inverted U-shaped internal connector 20 is made of spring clip metal which has depending side legs 104 which have saw teeth 20*b* for cooperating with the saw teeth 42*b* of the upstanding seam flanges 14 to provide an additional metal reinforcement holding power to the holding achieved by the top flange 46. The interior connector 22 may be longer than the base flange 48 of the clip 18 to improve holding under uplift loads. Thus, the internal connector 20 assists in holding the ends of the respective glazing panels 12 against the force that wants to enlarge the gap 25 and remove the glazing panels from the glazing panel system.

The external connector 22 shown in FIG. 23 has lower saw teeth 40 below the depending legs 104 with these saw teeth engaging the lowermost teeth 42*a* of the upstanding seam flange 14 to retain the connector 22 in its weather guard position over the U-shaped internal connector 20. Thus, the internal connector which is made of metal provides an additional holding force means to hold the panels together beyond that of the top flange 46 of the convention construction.

Figure 24:
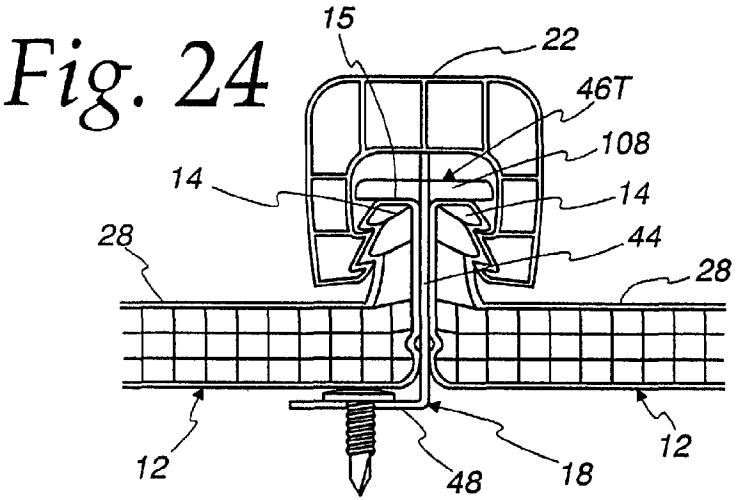
FIG. 24 illustrates the retention clip of FIG. 25 in a cross-sectional view of an assembled glazing panel system.
Figure 25:
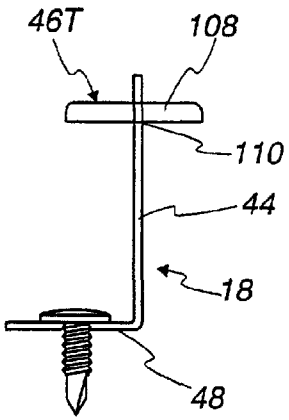
FIG. 25 shows a thicker top flange extending transversely within the slot of the central web of the clip of FIG. 26.
Figure 26:
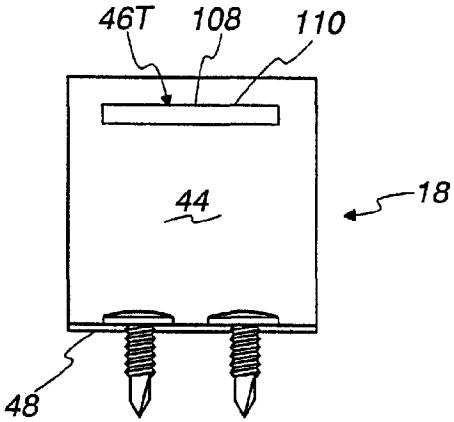
FIG. 26 is a side elevational view of a retention clip having a slot in the central web for receiving a thick, slidable top flange therein.

In accordance with a further embodiment of the invention illustrated in FIGS. 24, 25 and 26, the upper transversely extending flange 46 may be in the form of an increased thickness cross-sectional, transverse member or plate 108 relative to the thickness of the rest of the retention clip that slides within a slot 110 or is otherwise connected to the lower portion of the retention clip which is less thick and which includes the upstanding web 44 and the lower base flange 48 which is secured to the purlin by suitable fasteners. As disclosed and described in the aforementioned U.S. Pat. No. 6,164,024, it was conventional practice to have a piece of sheet metal having a preferred thickness with one-half of it bent at the upper end to the left 46*x* (FIG. 7A) and one-half (46*y*) of it bent to the right. As described above in connection with FIGS. 7A-7C, the bending strength may be insufficient to resist the uplift loads trying to bend these short flanges upwardly and allowed the escape of the glazing panels when very high velocity winds were flowing across the tops of the glazing panels. Herein the transverse, upper flange or portion 46 is in the form of a thick bar which is substantially thicker, for example, at least as twice as thick as the thickness of the bent metal, remainder of the retention clip 18. The transverse plate 46T is a flat rectangular plate made of the desired thickness and positioned in the slot 110 adjacent the upper end of the upstanding web 44 of the retention clip. The web 44 will have sufficient tensile strength when it is loaded with an upward pull from the transverse plate 46T as high winds flow across the glazing panels. The thicker transfer plate will have greater bending strength to resist the bending thereof by the seam flanges. The thicker cross-sectional plate 108 preferably extends laterally, e.g., more than one half of the width of the upstanding web. The thicker transverse plate 46T is the embodiment illustrated in FIGS. 24-26 positioned over the top ends 15 of the upstanding seam flanges 14 and is covered by a suitable exterior connector 22. The upstanding web 44 of the retention clip is positioned between the ends of the respective glazing panels and has a lower flange 48 fastened to a supporting structure. It is desirable for the web 44 to be as thin as possible. Hence, the need to develop various means to achieve a thicker and longer top flange 46.

Figure 27:
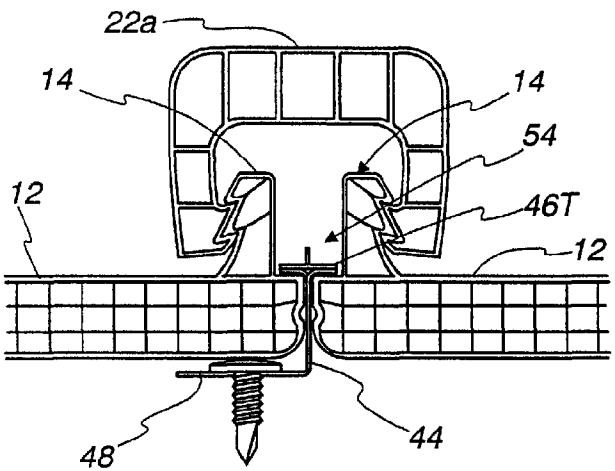
FIG. 27 is a cross-sectional view of the retention clip of FIG. 28 and is a cross-sectional view of an assembled glazing panel system.
Figure 28:
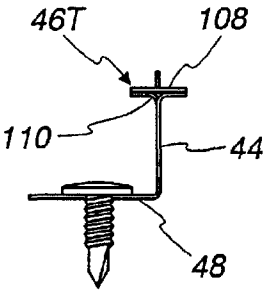
FIG. 28 illustrates a slidable, transverse upper flange mounted in a slot formed in the upper portion of the retention clip.
Figure 29:
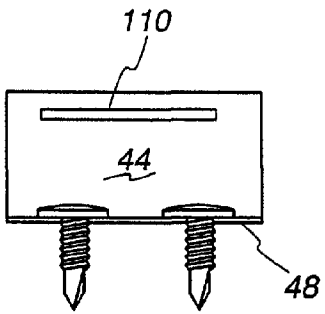
FIG. 29 is a view of a retention clip which is short and wider than the retention clip of FIG. 25.

Turning now to the embodiment of FIGS. 27-29 rather than having the additional thicker cross-sectional transverse plate 46T engaging the tops 15 of the upstanding seam flanges 14 as illustrated in FIG. 24, the construction be more similar to that shown in FIG. 8 wherein the glazing panel ends are provided with clip receiving pockets 54 at the base of the upstanding seam flanges 14 to receive the transversely extended member or plate 46T. The transverse member 46T is mounted in a slot 110 in the upstanding web 44 as best seen in FIGS. 28 and 29. Comparing the constructions shown in FIGS. 24-26 with that shown in FIGS. 27-29, the main difference between them is that the web 44 is of a much greater height in the FIGS. 24-26 embodiment than the height of the web 44 for the retention clip shown in FIGS. 27-29.

Figure 32:
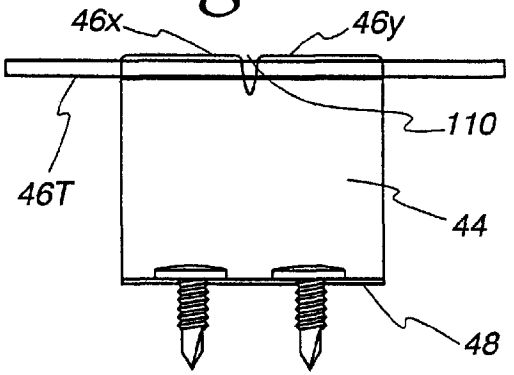
FIG. 32 is a front elevational view of the retention clip of FIG. 30 where the base flange is longer than the top flange.
Figure 31:
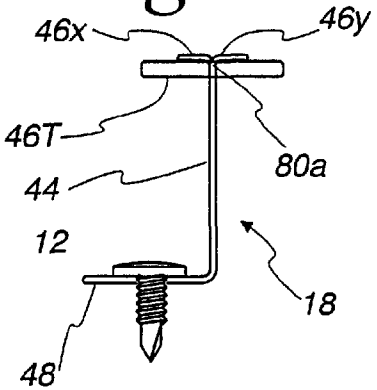
FIG. 31 is a side-elevational view of the retention clip of FIG. 30.
Figure 30:
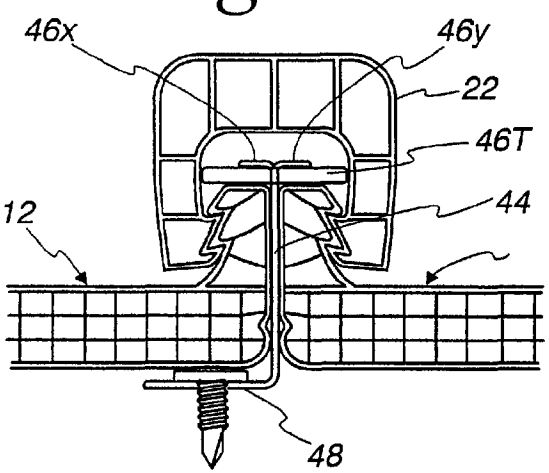
FIG. 30 is a cross-sectional view showing a thick bar and bent flanges forming a top flange for a retention clip.

In the embodiment of the invention shown in FIGS. 30-32, the retention clip 18 is also provided with a thicker, transverse member or upper flange 46T in the shape of a flat plate or member of increased cross-sectional thickness relative to the cross-sectional thickness of the web 44 of the sheet metal clip body to provide increased strength against bending of this top flange member for the retention clip. The top flange member 46T may have a greater width as seen in FIG. 32 than the web 44 and have a substantial thickness greater than the cross-sectional thickness of the web 44 to hold the panels against removal due to uplift loads. Herein the transverse flange 46T is positioned beneath a integral, bent retention top flange portions 46*x* and 46*y*, as best seen in FIGS. 31 and 32. The portions 46*x* and 46*y* are separated as seen in FIG. 32 by an intervening slot 110 with one flange portion 46*y* being bent to the right at right angles to the web 44 and the other portion 46*x* being bent to the left. The bent flange portion and the plate 46T may be welded together.

The top plate 46T has a central slot 80*a* (FIG. 31) that allows the bar to be assembled to the rest of the clip by sliding the base flange 48 into the slot and then sliding the top plate 46 upwardly along the central web 44 to abut the undersides of the bent portions 46*x* and 46Y. The plate 46T may then be spot welded to the bent portions 46*x* and 46Y to provide a composite top flange on the retention clip formed of the thicker top plate 46T and the bent portions 46*x* and 46Y.

As shown in FIG. 30, the upper flange 46 which comprises the combined bent flanges 46*x*, 46*y* and the transverse plate 46T, may be positioned over the tops 15 of the upstanding seam flanges 14 on the respective glazing panels 12 to resist the uplift loads and keep the glazing panels in position during high wind velocity fall across the outer surface of the glazing panel.

Figure 39:
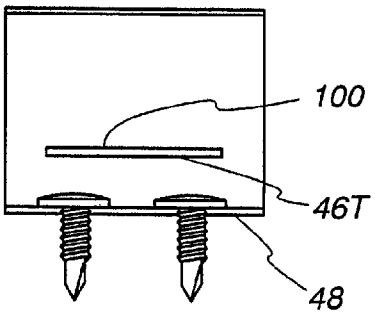
FIG. 39 is a side elevational view of the retention clip shown in FIG. 38.
Figure 38:
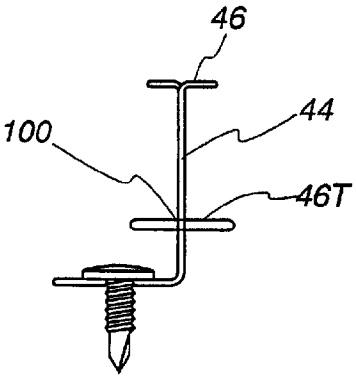
FIG. 38 is a cross-sectional view of a retention clip with an upper and lower transverse flange.
Figure 37:
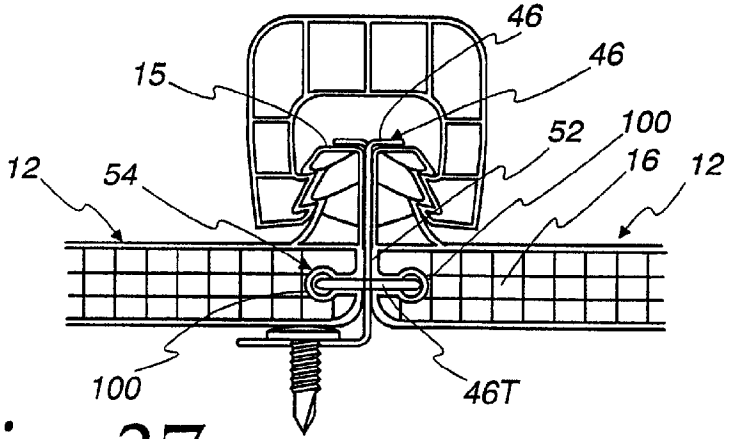
FIG. 37 is a cross-sectional view of a glazing panel having a further clip connector with a pair of transverse flanges as shown in FIGS. 38 and 39.

In the embodiment shown in FIGS. 37-39, the clip 18 is provided with a plurality of transverse members 46 and 46T to engage the panel ends 52 to provide resisting points at vertically spaced locations along the ends of the glazing panels 12. For example, in addition to the upper, top flange 46 in the form of a transversely extending member, there is also a lower transversely extending members or flanges 46T mounted in the slot 100 in the web 44 as best seen in FIG. 39. The preferred construction shown in FIGS. 37-39 has the intermediate thick plate 46T positioned within pockets 54 disposed in the center of the panel, e.g., in internal rib structure 16 and projecting inwardly into the ends 52 of the glazing panels 12 in a manner similar to FIG. 22 except that the plate 46T does not have the enlarged ends. The plate 46T is received in the pockets 54 and the upper flange portion 46 is positioned over the ends 15 of the upstanding seam flanges 14. Thus, any uplift loads will be resisted by the intermediate lower thick plate 46 which should not bend and which is located beneath the upstanding seam flanges 14 at the ends 15 of the glazing panels 12 while the uppermost flange 46 has bent flange portions 46*x* and 46*y* which are engaging the top ends 15 of the upstanding seam flanges 14 and which are integral with the web 44. The web 44 has a thinner cross-sectional thickness than that of the plate 46T. Thus, the panels are held down at two spaced hinging points as the uplift loads try to enlarge a gap 17 between lower ends of the glazing panels and thereby lift the glazing panels from the glazing panel system 10.

Figure 33A:
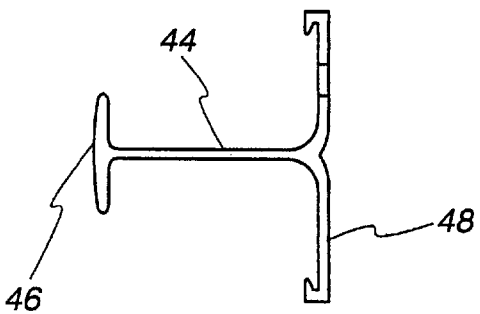
FIG. 33A is a side elevational view of the retention clip of FIG. 33.
Figure 33C:
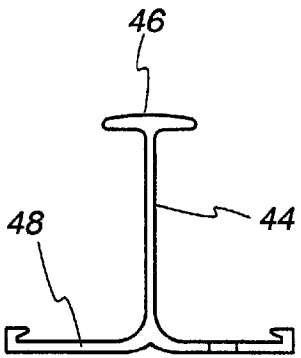
FIG. 33C is a side elevational view of the retention clip of FIG. 33B.
Figure 33:
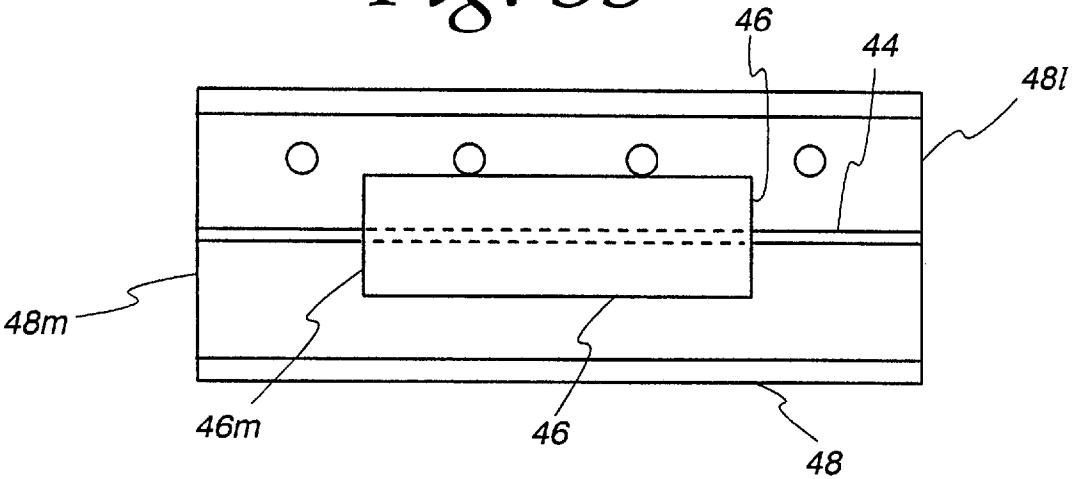
FIG. 33 is a plan view of a retention clip.

In the embodiment of FIG. 33, a retention clip 18 is illustrated in a plan view as having a base flange 48 having a longer length from one end 481 to its other end 48*m* then the length of the top flange 46 between one end 461 and its opposite end 46*m*. Thus, top flange 46 may be either shorter or longer in length than the base flange 48 as well as equal in length.

Figure 33B:
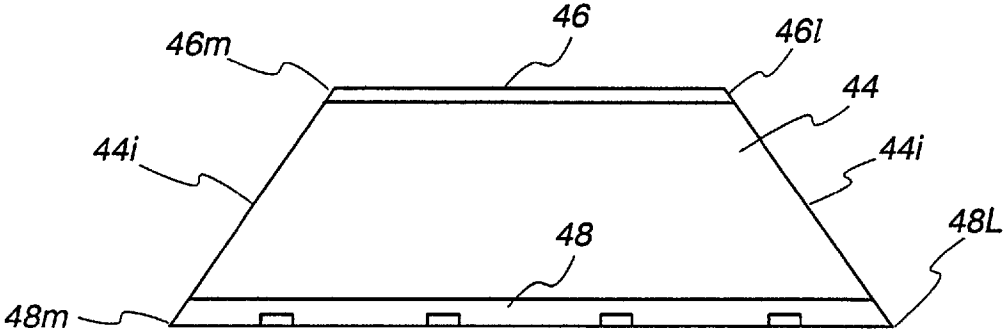
FIG. 33B is an elevational view of a retention clip with a top flange shorter in length than the bottom flange.

The embodiment of FIGS. 33*b* and 33*c* illustrates a top flange 46 having a shorter length between its ends 461 and 46*m* than the base flange 48 in length between its ends 481 and 48*m*. The web 44 in FIG. 33 has inclined ends 44*i* extending between the ends 461 and 481 and the ends 46*m* and 48*m*.

Figure 36:
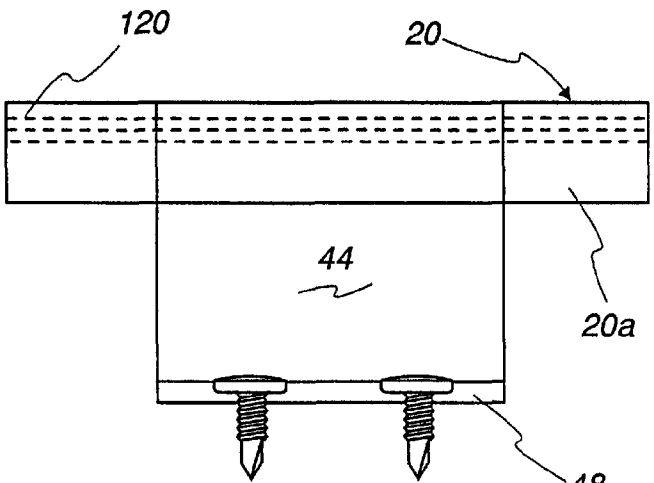
FIG. 36 is a side-elevational view of the retention clip of FIGS. 34 and 35.
Figure 35:
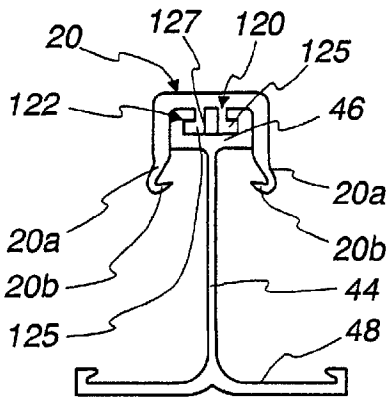
FIG. 35 is a cross-sectional view of the retention clip shown in FIG. 34.
Figure 34:
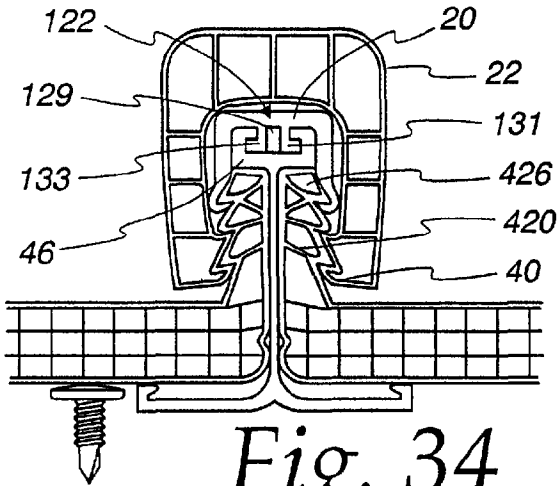
FIG. 34 is a cross-sectional view illustrating another retention clip system having the retention clip shown in FIGS. 35-36.

In the embodiment illustrated in FIGS. 34-36, an internal connector 20 (FIG. 35) is formed as a metal extrusion with integral depending legs 20*a* and a central key portion 120 for sliding insertion into a key slot 122 formed in the top flange 46 at the upper end of the web 44 of the clip 18. As seen in FIG. 36, the internal connector 20 is larger than the web 44 and the base flange 48 of the retention clip. The key portion 120 and key slot 122 function in the manner of a dovetail to prevent upward separation of the internal connector 20 from the retention clip 18 when the glazing panels are hinging and trying to push the connector 20 upwardly to disengage its teeth 20*b* from the teeth 42*b* on the upstanding seam flanges 14. The longer length of the internal conductor relative to the length of the base flange 48 is possible because the length of the base flange 48 is usually limited to the dimensional width of the underlying purlin so that the base flange 48 is not visible from beneath when looking upwardly at the purlin. In contrast, the internal connector is located above the glazing panels 12 and is covered by an exterior connector 22. Herein, the central key portion of the internal connector has a pair of laterally extending feet 125 separated by a central slot 127 into which projects a central bar 129 (FIG. 34) on top flange 46 at the upper end of the central web 44 of the retention clip 18. The key portion has a pair depending legs 131 carrying the laterally extending feet 125 which extend laterally into the slots 133 on the opposite sides of the central bar 129. The external connector 22 has its teeth 40 engaging the lower teeth 42*a* on the seam flanges 14 while the internal connector teeth 20*b* are positioned for engaging the upper teeth 42*b* on the seam flanges under high uplift loads. Thus, the internal connector 20 is keyed to the top flange 46 of the clip to hold the internal connector against disengagement from the seam flanges under high uplift loads. The upward push on the internal connector applies an upward pull on the top flange 46 and the web 44. This pull is then transmitted to the base flange which is fastened to a purlin.

Figure 41:
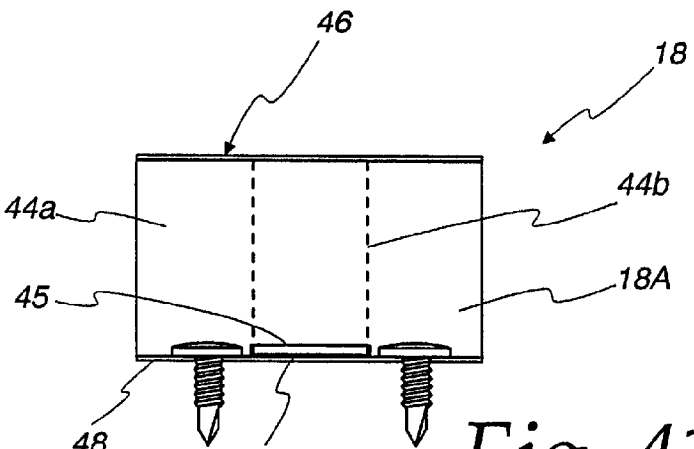
FIG. 41 is a side-elevational view of the retention clip used in the glazing panel system shown in FIG. 40.
Figure 40:
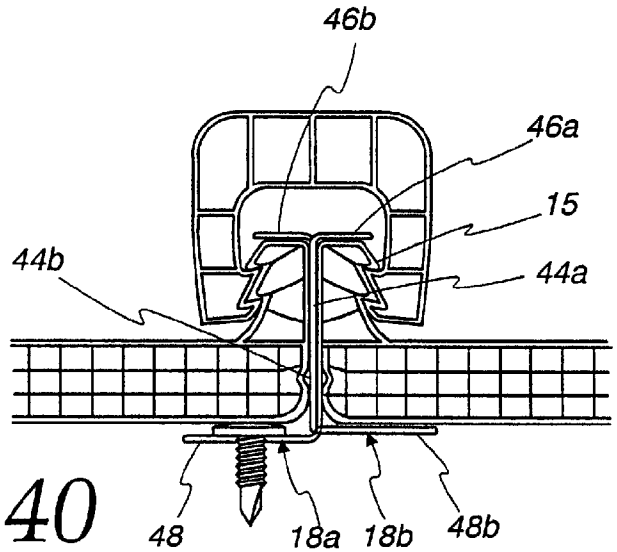
FIG. 40 is a cross-sectional view of a glazing panel system having another clip connector embodiment as shown in FIG. 41.

In the embodiment of FIGS. 40 and 41, the retention clip 18 is formed of two bent metal clip halves 18*a* and 18*b* of Z-shape which are joined together. As best seen in FIG. 41, the bent clip half 18*a* has a wide underlying base flange 48 extending to the left in FIG. 40 to receive the fasteners to fasten the clip to a purlin. The clip 18 has an upstanding central web 44*a* and a top flange portion 46*a* bent to extend to the right to overly the top end 15 of the right seam flange 14. The other Z-shaped half 18*b* inserted through a slot 145 in the upstanding web 44*a* adjacent the upper side of the base flange 48 on the clip half 18*a*. This base flange portion 48*b* extends to the right as viewed in FIG. 40. The upstanding web 44*b* of the clip portion 18*b* is on the left side of the web 44*a* of the other half 18*a*. At the upper end of the web 44*b* is a leftward bent, integral top flange portion 46*b*. Thus, the top flange 46 is comprised of the leftward flange portion 46*b* and the right hand flange portion 46*a*.

Figure 43:
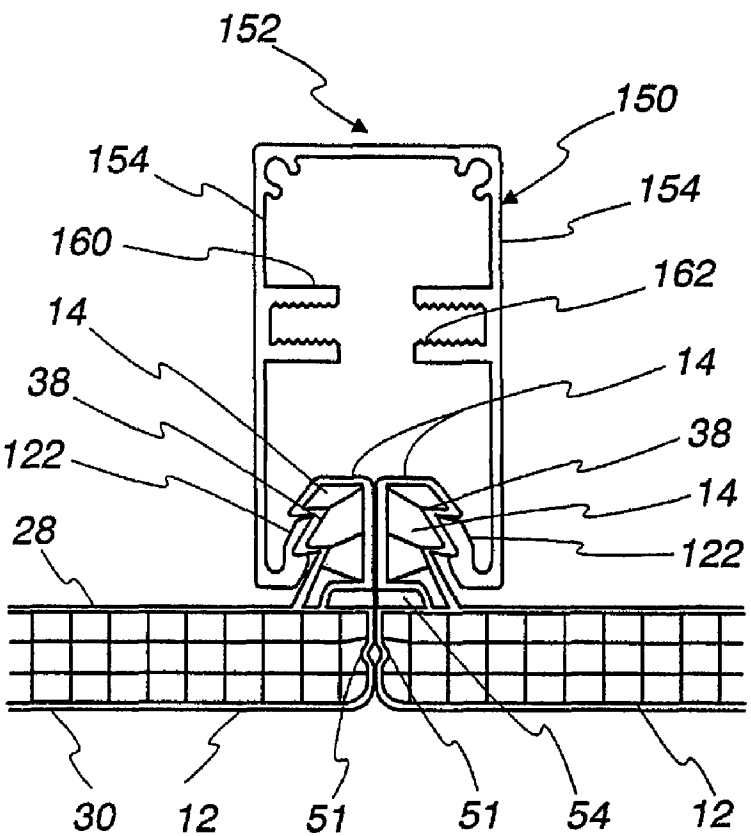
FIG. 43 is a cross-sectional view of the glazing panels shown in FIG. 8 and having a metal connector joining the upstanding seam flanges adjacent glazing panels.
Figure 42:
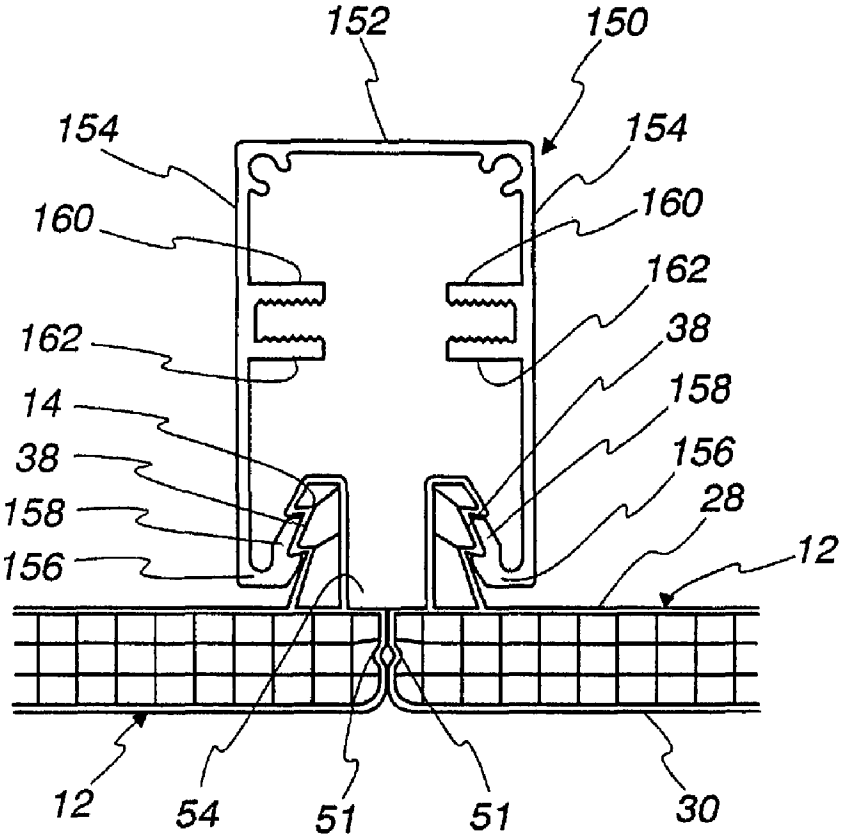
FIG. 42 is a cross-sectional view of the glazing panels shown in FIG. 11 and having a metal connector joining the upstanding seam flanges of adjacent glazing panels.

In the embodiment illustrated in FIGS. 42 and 43, the plastic batten connector 22 has been replaced by a metal connector 150 which serves both as a weather protector to provide a leak proof seam between adjacent panels as well as a strong connector to hold adjacent panels against strong uplift loads from high winds. No metal clips 18 are used in these embodiments of FIGS. 42 and 43. The illustrated connectors 150 are illustrated as being hollow rectangular tubes or bars having an extruded top wall 152 and integral sidewalls 154. At the lower ends of the sidewalls, there are inturned ends 156 that have upstanding saw teeth 158 to engage the saw teeth 38 on the upstanding seam flanges 14. The lower ends of reinforcing members are sufficiently flexible that they can be sprung and expanded outwardly as the lower ends of the reinforcing members are pushed downwardly over the upstanding seam flange 14. Then, the lower ends of the sidewall 154 snap back to engage its meal saw teeth 158 with the plastic saw teeth 38 on the respective adjacent glazing panel ends 51. The illustrated reinforcing members 150 have a pair of spaced, parallel short jaw members 160, 162 projecting internally from the respective vertical side walls 154 which serve to stiffen the upper portion of the reinforcing member relative to the expandable lower, saw tooth bearing lower portion of the reinforcing member. The glazing panels illustrated in FIG. 42 are identical to the glazing panels illustrated in FIG. 11 with the upstanding seam flanges 14 being spaced apart by a distance substantially equal to the width of a retention clip top flange 46 which is positioned in this space in the FIG. 11 embodiment but is not present in this space in the FIG. 42 embodiment. The reinforcing member 150 for the FIG. 42 embodiment has a wider width, that is a wider cross-section as viewed in FIG. 42 than the width of the reinforcing member 150 in the FIG. 43 embodiment.

The glazing panels 12 in the FIG. 43 embodiment are identical to the glazing panels illustrated in FIG. 8; but the clip receiver pockets 54 are empty in FIG. 43 whereas the clip receiver pockets 54 in the FIG. 8 embodiment are filled with the top flange 46 of the retention clip 18. Thus, the new glazing panels illustrated in FIGS. 1 and 4, may be joined by either reinforcing members 150 or by the reinforcing clips 18. The reinforcing members 152 differ from the retention clips 18 in that they have no base flange 48 secured to a purlin as do the retention clips.

Figure 44:
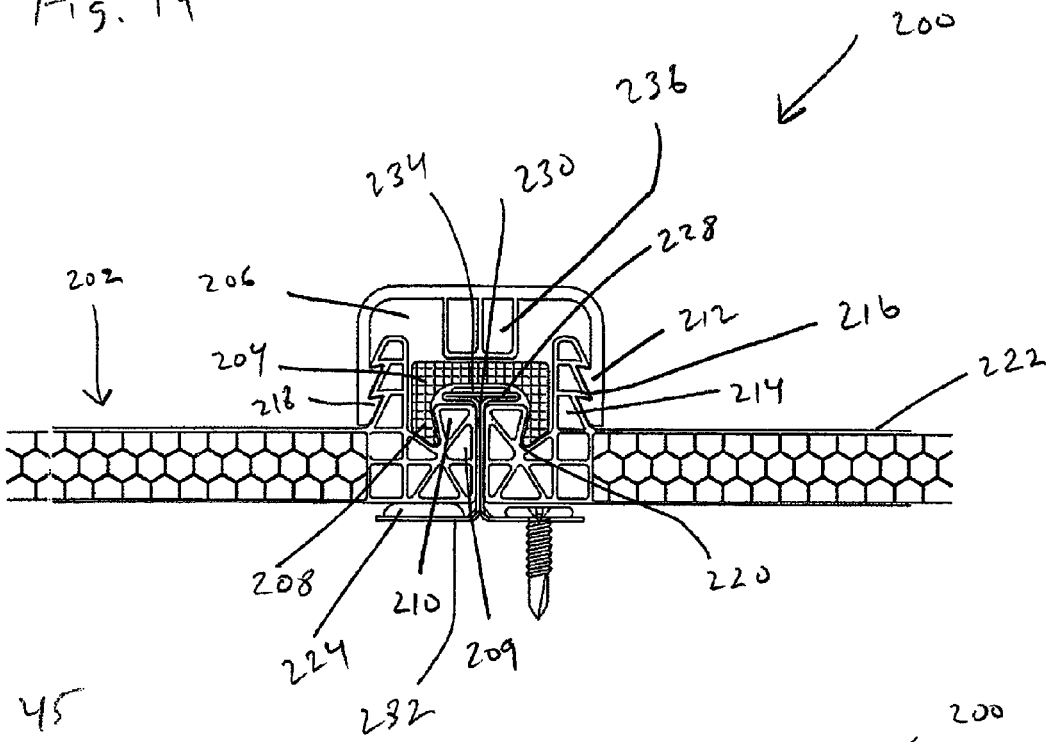
FIG. 44 is a cross-sectional view of an alternative glazing panel system having a connector with a depending portion.
Figure 45:
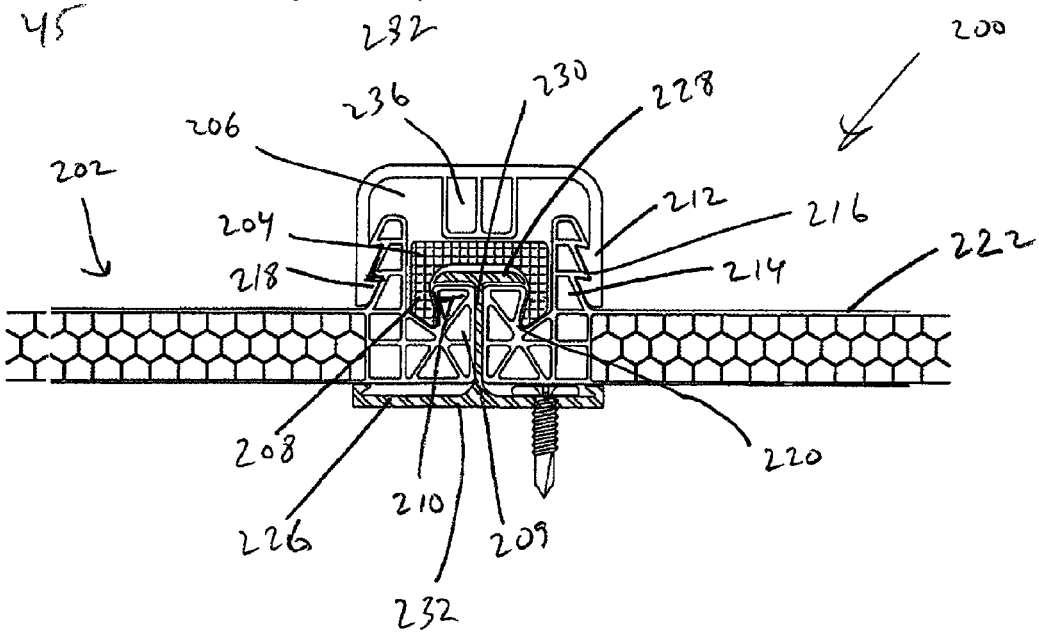
FIG. 45 is a cross-sectional view of a second alternative glazing panel system having a connector with a depending portion.

Two additional embodiments are show in FIGS. 44 and 45. In these embodiments, a glazing panel system 200 is used to hold two glazing panels 202 together, in which an internal connector 204 and an external connector 206 cooperate to retain the glazing panels 202 against high wind loads. The internal connector 204 is preferably in the form of an inverted U-shaped channel with two depending legs 208 for engagement with a pair of first seam flanges 210 with each first seam flange 210 positioned at a respective end 209 of the two glazing panels 202. Similarly, the external connector 206 is preferably in the form of an inverted U-shaped channel with depending legs 212 for engagement with a pair of second seam flanges 214. Each second seam flange 214 is preferably spaced horizontally from each first seam flange 210 along each glazing panel 202 with the first seam flange 210 closer to the retained end 209 of the panel 202. The second seam flanges 214 preferably include teeth 216 for engagement with corresponding teeth 218 on each depending leg 212 of the external connector 206.

The glazing panel system 200 includes pockets or grooves 220 formed in the top sheet 222 of each glazing panel 202. The depending legs 208 of the internal connector 204 extend into these pockets 220 to a location below the top sheet 222 for gripping engagement with the first seam flanges 210. The depending legs 208 within the pockets 220 apply a holding force to resist hinging and separation of the glazing panel ends 209.

Each embodiment also preferably includes its own retaining clip 224 and 226, respectively. Each retention clip 224 and 226 has a top flange 228 that preferably lies horizontally across the top surfaces of the pair of first seam flanges 210. Each retention clip 224 and 226 further includes a vertical web 230 that connects the top flange 228 to a base flange 232. The vertical web 230 is positioned between the respective first seam flanges 210 of the glazing panels 202, and the base flange 232 extends horizontally beneath the glazing panels 202. The internal connector 204 is in covering engagement with the top flange 228 of each retaining clip 224 and 226.

As can be seen from FIGS. 44 and 45, the retention clips 224 and 226 each have a slightly different preferred shape. As shown in FIG. 44, the retention clip 224 is made of bent metal, such as sheet metal, in which the vertical web 230 and top flange 228 essentially have a double ply thickness. The retention clip 224 also includes a top reinforcement plate 234, preferably welded to the top flange 228, to provide additional strength. In contrast, as shown in FIG. 45, the retention clip 226 is preferably made of a thicker, extruded, single-ply metal construction.

The external connector 206 also preferably includes a depending central leg 236. As shown in FIGS. 44 and 45, this depending leg 236 projects downwardly from the external connector 206 to engage the top of the internal connector 204 or to terminate just above the top of the internal connector 204. This depending leg 236 provides an additional downward force to hold the internal connector 204 in place. The depending leg 236 limits significant movement of the internal connector 204 and thereby prevents hinging and separation of each retaining clip 224 and 226.

The foregoing relates to preferred exemplary embodiments of the invention. It is understood that other embodiments and variants are possible which lie within the spirit and scope of the invention as set forth in the following claims.

The invention claimed is:

1. A glazing panel system comprising:

a first and second glazing panel, each glazing panel having a top surface and a first end, the two first ends defining a seam between the two glazing panels;

a first upstanding seam flange projecting from each glazing panel at or near each first end, each of the two first upstanding seam flanges having a first engagement surface;

an external connector having a transversely extending portion joining two outer depending legs, each of the outer depending legs having a corresponding second engagement surface, the first outer leg engaging one of the first upstanding seam flanges and the second outer leg engaging the other of the first upstanding seam flanges such that the external connector covers the seam and both first upstanding seam flanges;

a second upstanding seam flange projecting from each glazing panel at or near each first end and projecting to the same side of each glazing panel as each first upstanding seam flange, each of the two second upstanding seam flanges having a third engagement surface; and an internal connector having a transversely extending portion joining two outer depending legs, each of the outer depending legs having a corresponding fourth engagement surface, the first outer leg engaging one of the second upstanding seam flanges and the second outer leg engaging the other of the second upstanding seam flanges such that the internal connector covers the seam and both second upstanding seam flanges and is mounted on the same side of each glazing panel as the external connector;

wherein the external connector has a central leg depending from the transversely extending portion between the outer depending legs.

2. A glazing panel system in accordance with claim 1 wherein the central leg engages the transversely extending portion of the internal connector.

3. A glazing panel system in accordance with claim 1 wherein the internal and external connectors each form an inverted U-channel shape.

4. A glazing panel system in accordance with claim 1 wherein the first engagement surfaces and second engagement surfaces are gripping surfaces such that each first upstanding seam flange has a first gripping surface for engagement with a corresponding second gripping surface of each external connector outer leg.

5. A glazing panel system in accordance with claim 4 wherein the first and second engagement surfaces are toothed surfaces.

6. A glazing panel system in accordance with claim 1 wherein the central leg is located above the seam.

7. A glazing panel in accordance with claim 1 further comprising a pocket formed in the top surface of each glazing panel, each pocket receiving one of the two outer depending legs of the internal connector.

8. A glazing panel in accordance with claim 7 wherein each pocket is formed between the first and second upstanding seam flanges of each panel.

9. A glazing panel system in accordance with claim 1 further comprising a retention clip disposed in the seam between the two glazing panels.

10. A glazing panel system in accordance with claim 9 wherein the retention clip comprises a web portion extending upwardly between the seam flanges and a top flange portion extending over the top ends of the respective second upstanding seam flanges.

11. A glazing panel system in accordance with claim 10 wherein the internal connector is in covering engagement with the top flange portion of the retention clip.

12. A glazing panel system in accordance with claim 9 wherein the retention clip is made of extruded metal.

13. A glazing panel system in accordance with claim 9 wherein the retention clip is formed of a bent piece of sheet metal.

14. A glazing panel system in accordance with claim 13 further comprising a reinforcement plate that engages the top flange portion of the retention clip.

15. A glazing panel system in accordance with claim 9 wherein the retention clip further comprises a base for being secured to a support member for the glazing panels.

* * * * *